US007506907B1

(12) United States Patent
Marler

(10) Patent No.: US 7,506,907 B1
(45) Date of Patent: Mar. 24, 2009

(54) APPARATUS FOR THE LATCHING AND UNLATCHING OF A LOAD

(76) Inventor: Joseph E. Marler, P.O. Box 134, Livingston, LA (US) 70754

( * ) Notice: Subject to any disclaimer, the term of this patent is extended or adjusted under 35 U.S.C. 154(b) by 247 days.

(21) Appl. No.: 11/481,472

(22) Filed: Apr. 20, 2006

Related U.S. Application Data

(63) Continuation-in-part of application No. 10/906,129, filed on Feb. 3, 2005, now Pat. No. 7,032,943.

(51) Int. Cl.
*B66C 1/34* (2006.01)

(52) U.S. Cl. ..... 294/82.31; 294/82.34; 294/75; 294/905; 294/907

(58) Field of Classification Search ..... 294/82.3, 294/82.31, 82.33, 82.34, 905, 907, 75
See application file for complete search history.

(56) References Cited

U.S. PATENT DOCUMENTS

| | | | | | |
|---|---|---|---|---|---|
| 2,904,369 | A | * | 9/1959 | Campbell | 294/82.3 |
| 3,630,562 | A | * | 12/1971 | Metz | 294/82.33 |
| 4,077,661 | A | * | 3/1978 | Inahashi | 294/82.3 |
| 4,453,622 | A | * | 6/1984 | Betz | 188/265 |
| 4,471,511 | A | * | 9/1984 | Phipps | 294/82.33 |
| 4,530,535 | A | * | 7/1985 | Hargreaves | 294/82.33 |
| 4,572,563 | A | * | 2/1986 | Fontana | 294/82.24 |
| 4,573,725 | A | * | 3/1986 | Griffiths | 294/82.28 |
| 4,618,179 | A | * | 10/1986 | Mampaeij | 294/82.31 |
| 5,267,765 | A | * | 12/1993 | Diethelm et al. | 294/82.31 |
| 5,795,001 | A | * | 8/1998 | Burke | 294/64.1 |
| 6,089,634 | A | * | 7/2000 | Verhey | 294/82.35 |
| 7,032,943 | B1 | * | 4/2006 | Marler | 294/82.31 |

* cited by examiner

*Primary Examiner*—Dean J Kramer
(74) *Attorney, Agent, or Firm*—Roy, Kiesel, et al

(57) ABSTRACT

An improved apparatus for latching and unlatching a load from a sling comprises a housing attachable to a load lift line extending from a crane or other similar equipment. Contained at least partially within the housing is a load engaging assembly including a latch, such as a conventional sling hook used to attach a load containing sling. The load engaging assembly further includes a latch attachment assembly and an unlatching trigger assembly. The apparatus further includes a load activated lock operatively attached to the latch attaching assembly to latch and unlatch the load engaging assembly. The load activated lock includes a support structure affixed to the housing, a latch activating member slidably mounted on the support structure and a movable locking structure positioned within the housing and operatively adjacent the latch activating member to engage and prevent latch activating member from sliding movement when a load is applied to the latch. The apparatus further includes a compression switch affixed to the housing at a position to be activated when a load of a predetermined weight is attached to the latch. The apparatus further includes at least one remote controlled relay switches electrically connecting the compression switch, or alternatively a second compression switch, to the power unit of an adjustable clutch motor having a rotating drive shaft. The apparatus also including a remote control broadcasting device to emit predetermined signals to close at least one of the remote controlled relay switches. The drive shaft is attached a reel line affixed at its opposite end to the latch activating member. The drive shaft when activated will cause the reel line retract to operatively cause the latch activating member to move and cause the latch to be positioned for releasing the sling from the latch.

15 Claims, 29 Drawing Sheets

200
203
219
221
218
226
220
216
214
223
204
206
210
215
213
207
201
202
208
209
222
5

APPARATUS FOR THE LATCHING AND UNLATCHING OF A LOAD

RELATED APPLICATION

This is a continuation in part of U.S. Ser. No. 10/906,129, filed Feb. 3, 2005 now U.S. Pat. No. 7,032,943 and entitled "Apparatus for the Latching and Unlatching of a Load," and is hereby incorporated by reference in its entirety.

BACKGROUND OF THE INVENTION

1. Field of the Invention

This invention relates in general to apparatus for latching and unlatching a load from a sling and, more particularly, to such apparatus having a locking structure and one or more safety devices activated by the application of a force caused by the lifting of the load.

2. Prior Art

In construction and other commercial or industrial environments it is necessary to move a load from one place to another place. This movement is facilitated by the use of cranes having a lifting line to which slings can be attached for securing the load to the lifting line. Various devices used to latch and unlatch a load from these slings are well known in the prior art. In the design of these devices it is necessary to consider the multiple uses to which they will be employed, including the handling of various shape, size, and type loads. In addition these devices must not only be simple to operate, but only permit such operation in a manner that minimizes the risk that a load would be unlatched from the lifting line prematurely or conducted in a manner that may otherwise cause harm to personnel working around the site. Although some of these design criteria have been addressed by the prior art, there remains a need for their improvement.

Many construction sites have multiple tasks being performed by different personnel at the same time. Thus the different personnel are more likely to be focused on the tasks to which they have been assigned, and may not be aware of the other activities at the site. In addition the noise at these sites may be at a level that makes it difficult to provide an audible warning to personnel if something has mistakenly occurred, such as the premature release of a load from a lifting line.

Another problem relates to the manner in which the load is released from the latching device. It is the common practice to utilize a secondary line that is operatively attached to the latch which when pulled releases the latch and permits the load to be released from the lifting line. Such secondary lines in addition to being cumbersome are more susceptible to being inadvertently pulled before it is desired that a load be released from the lifting line. This inadvertent action can result not only in harm to surrounding personnel, but also damage to the load.

To minimize risk with the prior art devices, it is in many instances required that ground crews and other machinery slow their operations or come to a stand-still while the task of moving the load is completed. This adds both time and cost to the operation or construction occurring at the site.

OBJECTS OF THE INVENTION

It is an object of the invention to provide an improved apparatus with a latching and unlatching mechanism for the safe and efficient release of attached loads, so as to reduce operating time, as well as safety and cost concerns associated with moving loads.

It is another object of the invention to provide an improved apparatus for the loading and unloading of material, that includes an effective load-activated lock assembly assembly to prevent inadvertent release of attached loads, so as to provide optimal safety for personnel and equipment during the moving of loads.

It is another object of the invention to provide an improved apparatus for the loading and unloading of material, that includes an effective load-activated lock assembly assembly that is adjustable to the weight of the lifting sling and hardware, so as to prevent a premature locking.

Another object of the invention is to provide safety features to alert personnel working at the site that a load is being moved.

Still another object of the invention is to provide safety mechanisms to prevent the unintentional release of loads being transported by overhead slings from being engaged and released.

These and other objects and advantages of the invention shall become apparent from the ensuing figures and descriptions of the invention.

SUMMARY OF THE INVENTION

An apparatus for latching and unlatching a load from a sling is disclosed comprising a housing formed at least in part by parallel and separated front and rear plates that are fixed in parallel position relative to one another. This separation is maintained by at least one edge plate affixed to opposing perimeter sections of the front and rear plates. The apparatus also including a load engaging assembly comprising a latch, such as a conventional sling hook, to which the load can be attached, and a latch attaching assembly to which the latch is pivotally attached. The apparatus further includes a load-activated lock assembly having a support structure affixed to the housing, a latch activating member having a keyhole and positioned within the housing to slide over the support structure, and a moveable structure having a key member sized and shaped to fit into the keyhole. The moveable structure is biasly attached to the latch attaching assembly and positioned relative to the latch activating member to permit the key member to be inserted into the keyhole when the moveable structure is moved toward the latch activating member by the application of a load on the latch. The apparatus also includes a cable attached at one end to the latch and at its opposite end to one end of the latch activating member, as well as a load release line attached at one end to the opposite end of the latch activating member.

In preferred embodiments both visual and audio devices will be incorporated into the apparatus to provide warning when a load is being lifted. In these embodiments a switch is mounted to the housing at a position to be electrically closed when the apparatus is lifted with a load attached to the load engaging assembly. The switch is electrically connected to a power source and the visual and/or audio devices to activate them when the switch has been closed. In another embodiment one or more relay switches may be positioned in the electrical circuit to require their closing before the visual and/or audio devices are activated. In still another embodiment the apparatus further includes a motor affixed to the housing. The motor includes a power source also included in the electrical circuit and a rotating drive shaft. In this embodiment a reel line is fixed at one end to the drive shaft and at its opposite end to the latch activating member. In alternate embodiment the rotating drive shaft can be operatively attached to a hydraulic pump which in turn can be used to actuate the reel line or other known devices that can be used to manipulate the load activated lock assembly. When one or more of the relay switches are closed the motor is electrically connected to its power source to cause the drive shaft to rotate and retract a portion of the reel line causing the latch activating member to move and positioning the latch for releasing the sling holding the load. In a preferred embodiment the relay switches are remotely controlled by a remote control signal broadcast device that emits a predetermined signal or signals to close one or more of the relay switches.

A. BRIEF DESCRIPTION OF THE FIGURES

PREFERRED EMBODIMENTS OF THE INVENTION

Figure 1:
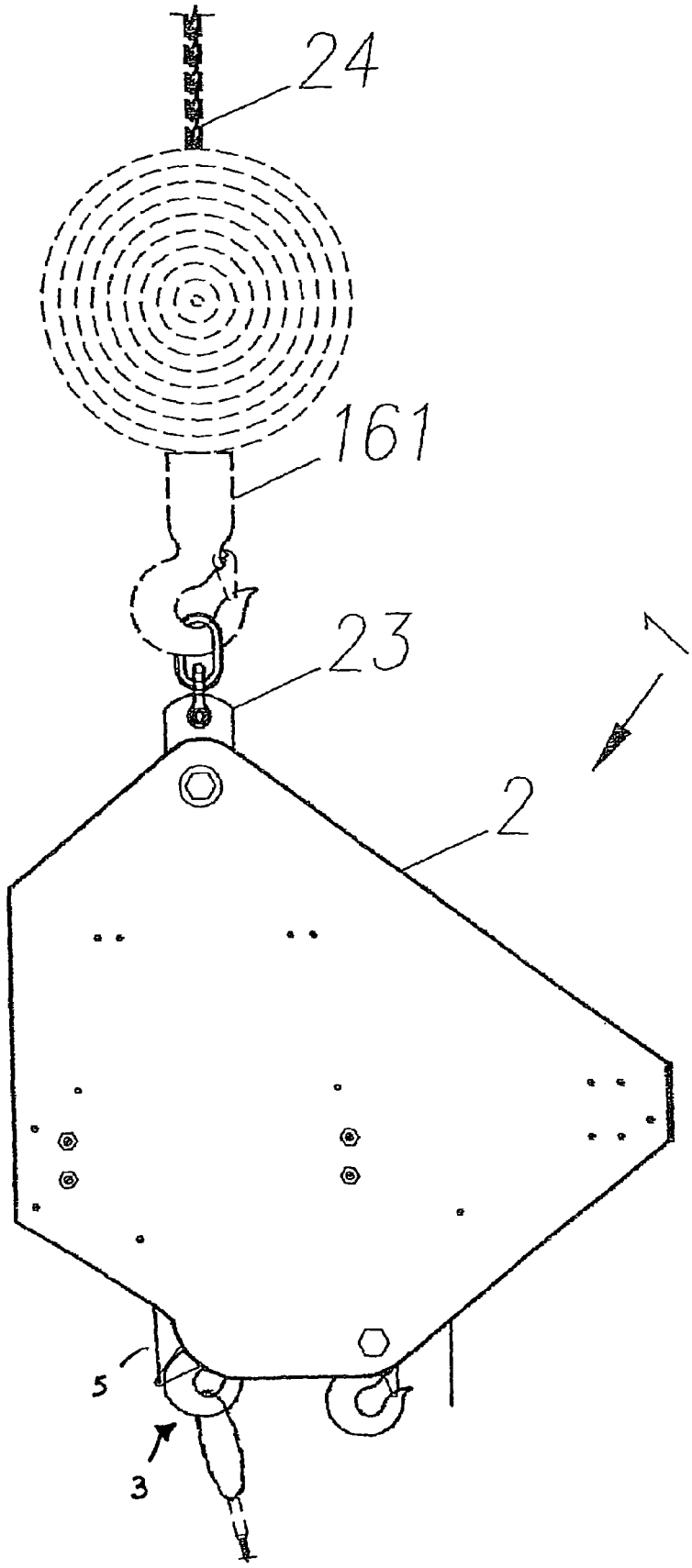
FIG. 1 is a side view of a preferred embodiment of the invention.

Without any intent to limit the scope of the invention, the preferred embodiments of the invention are illustrated in the Figures and described hereinbelow.

Referring to FIGS. 1-6 a preferred embodiment of the invention is illustrated. In its basic form the latching and unlatching apparatus 1 includes a housing 2, a load-engaging assembly 3; a load-activated lock assembly 8, a cable 4 having its end 5 operatively attached to load-engaging assembly 3 and it opposite end attached to load-activated lock assembly 8, and a load release line 6 for unlatching a load 7 attached to load-activated lock assembly 8.

Figures 2, 2A:
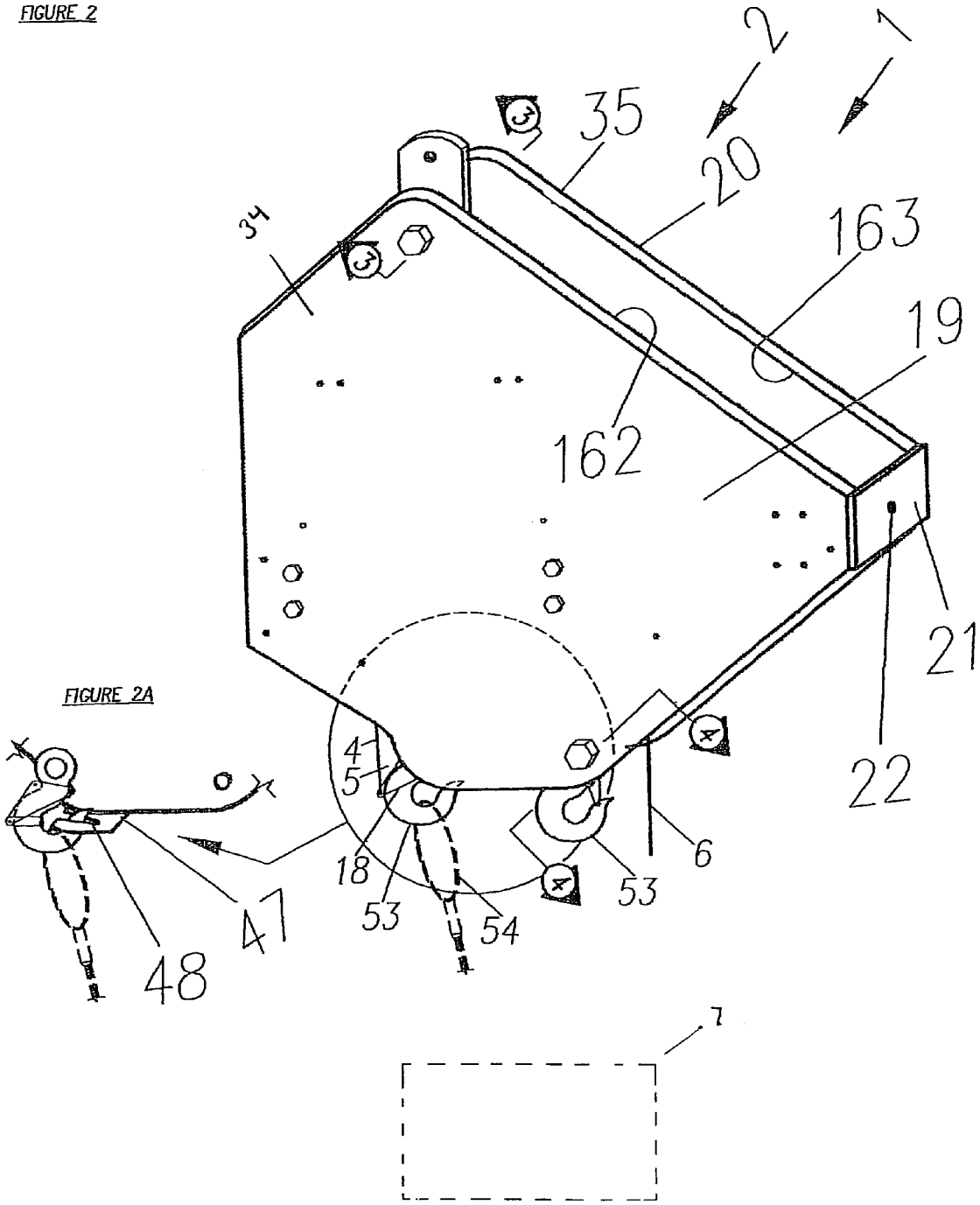
FIG. 2 is a three-quarter perspective embodiment of the invention, depicting the front and back plates of the housing.
FIG. 2A is an enlarged view of the circled area of FIG. 1, depicting the sling hook engaged to the guard latch.
Figure 5:
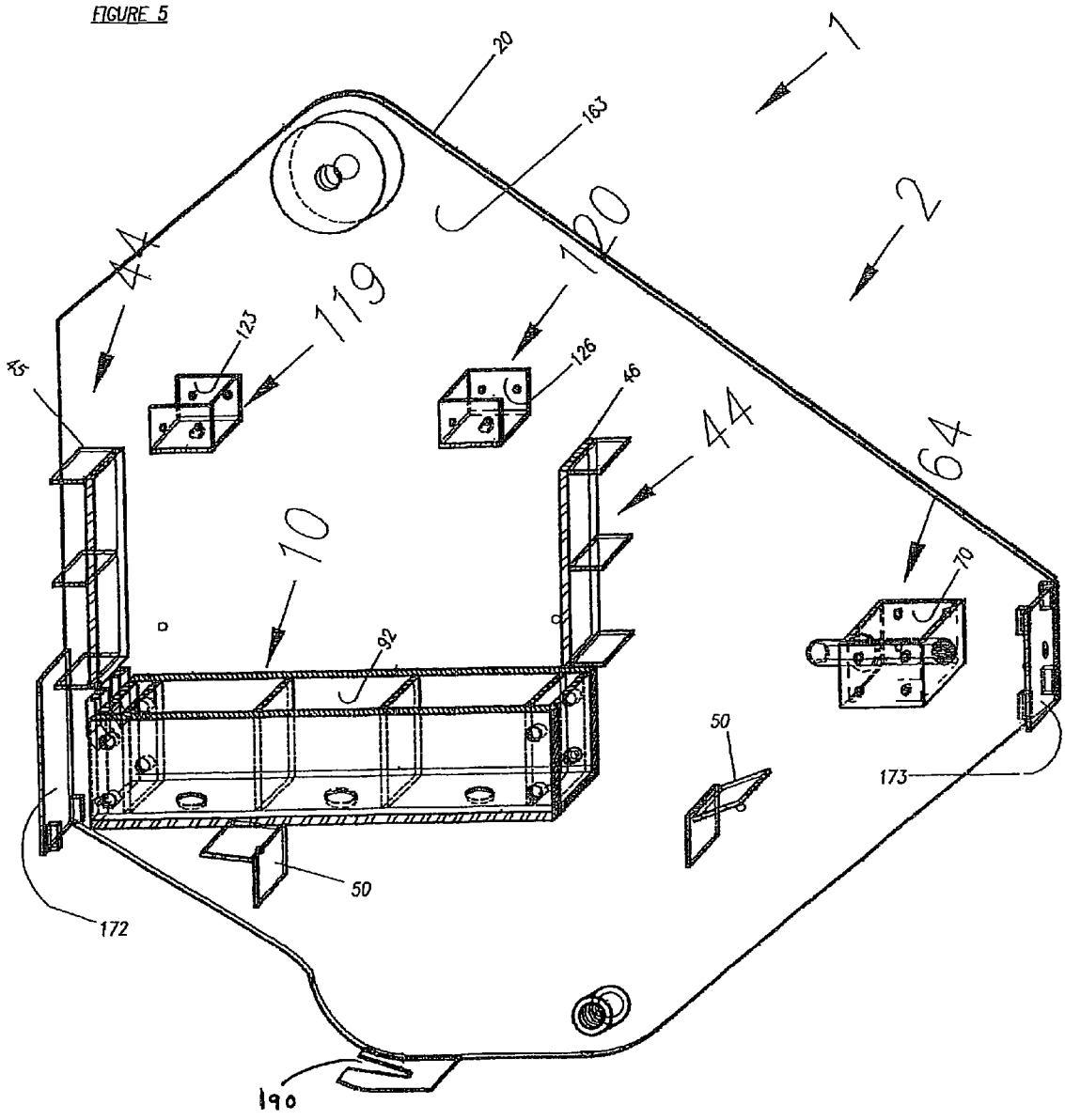
FIG. 5 is a three-quarter perspective view of a preferred embodiment of the invention depicting various components of the invention affixed to the back plate of the housing to provide points of attachment for the front plate and other components when invention is assembled.

As illustrated in FIG. 2, housing 2 includes parallel front plate 19 and back plate 20 separated from one another by spacer plate 21*a* sufficient distance to house at least in part the load-engaging assembly 3 and the load-activated lock assembly 8. As depicted by FIGS. 5, 11, and 1A, the spacing between front plate 19 and back plate 20 is also maintained by brackets 119, 120, 172 and 173, support structure 10, and upper and lower bolt assemblies 25 and 26, as is illustrated in more detail in other figures and described below.

Figure 13:
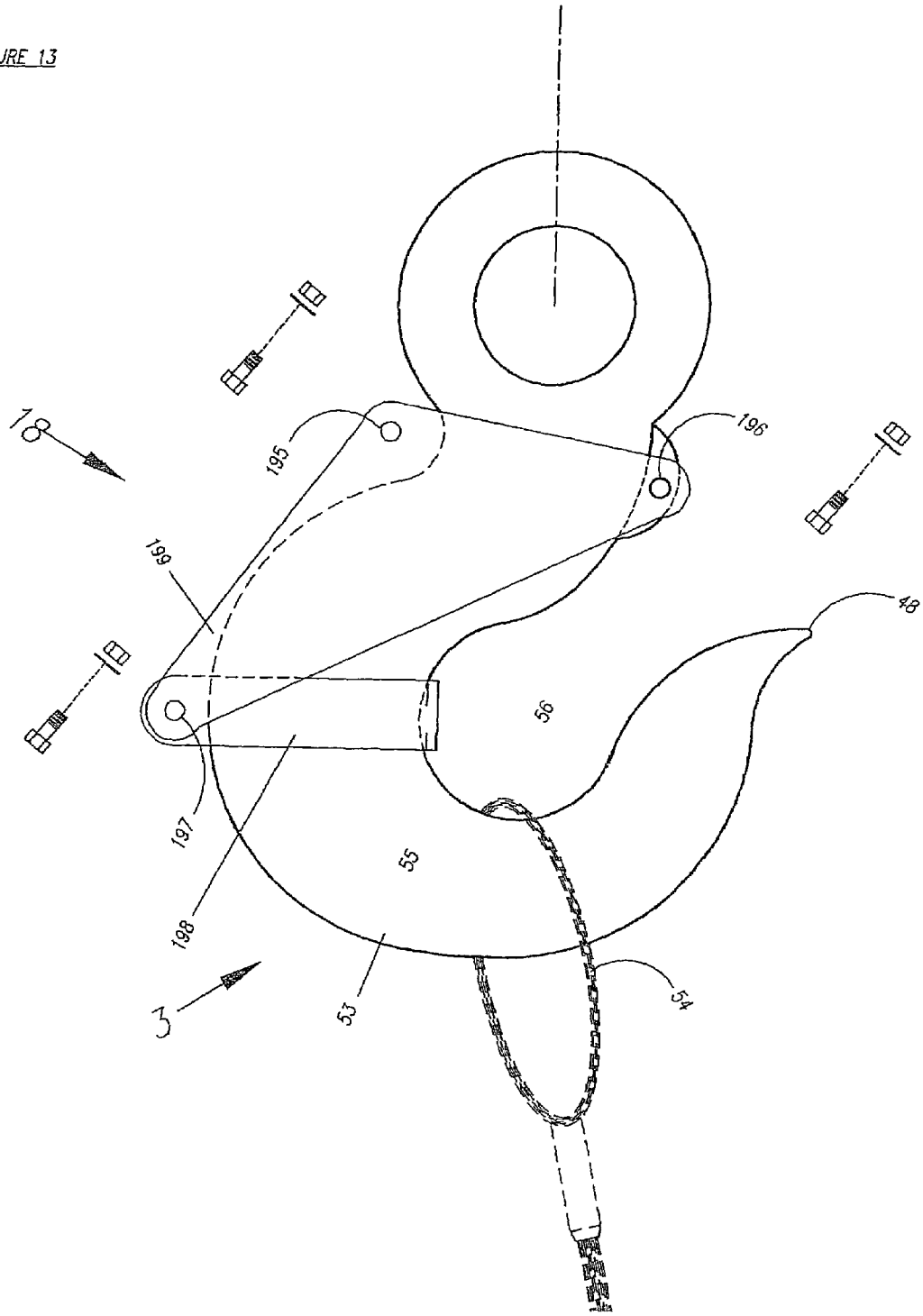
FIG. 13 is a view of the preferred embodiment of the unlatching trigger assembly and the sling hook.

As illustrated in more detail in FIG. 13, load engaging assembly 3 includes a latch, such as conventional sling hook 53, latch attachment assembly 17 and unlatching trigger assembly 18.

Figure 6:
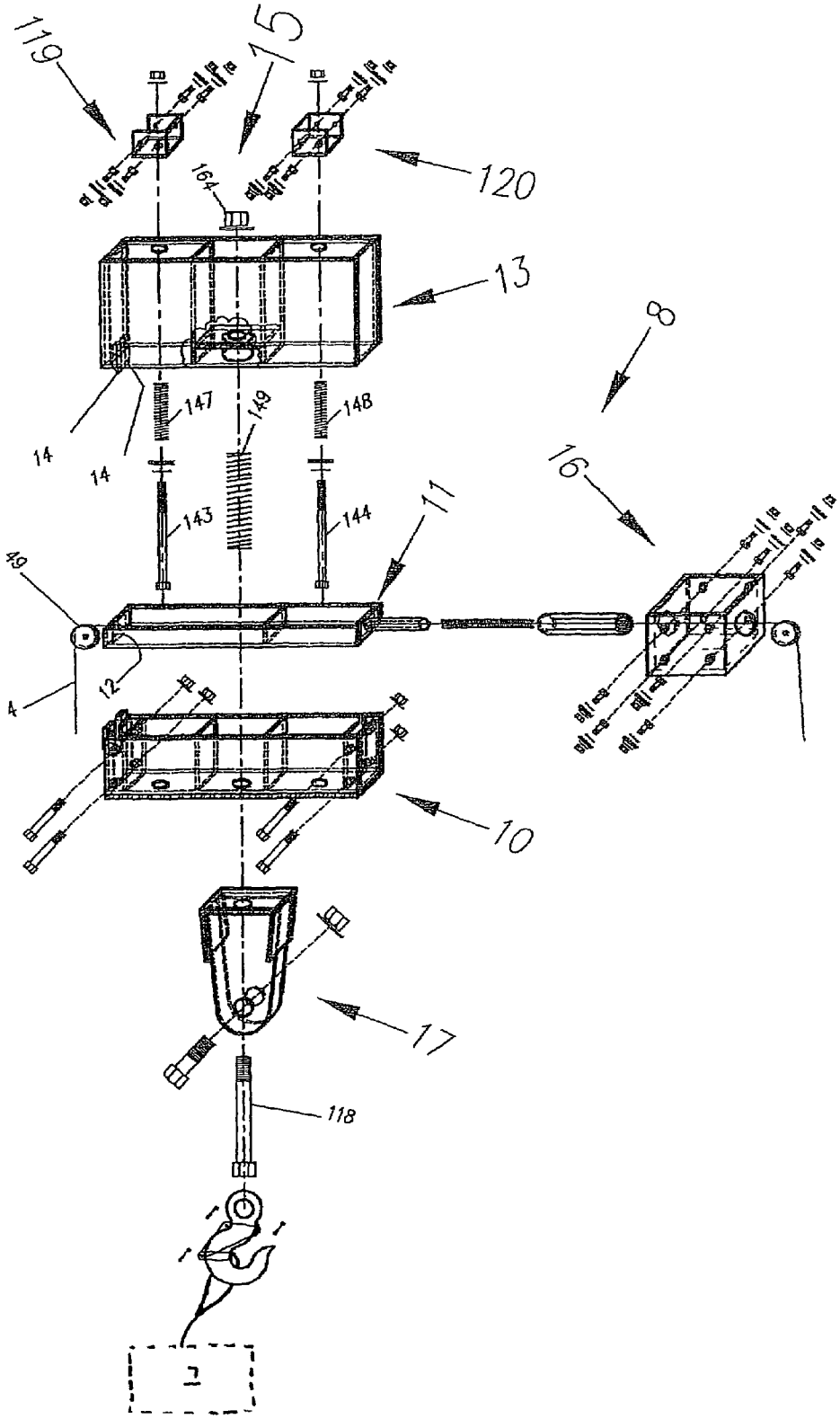
FIG. 6 is an exploded view of a preferred embodiment of the leveler assembly, the load-activated lock assembly, the compression spring assembly, the latch attachment assembly, the unlatching trigger assembly, and the load-engaging assembly.
Figure 7:
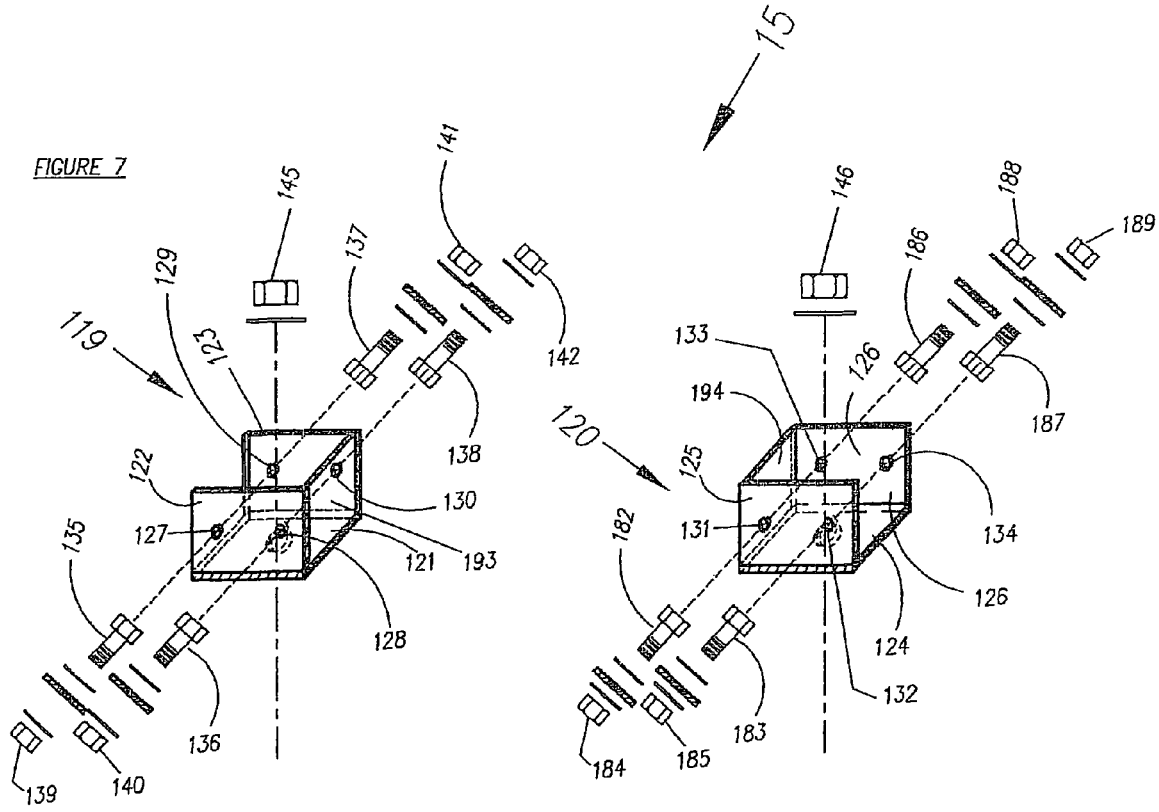
FIG. 7 is a three-quarter perspective and partial exploded view of the leveler assembly.
Figure 14:
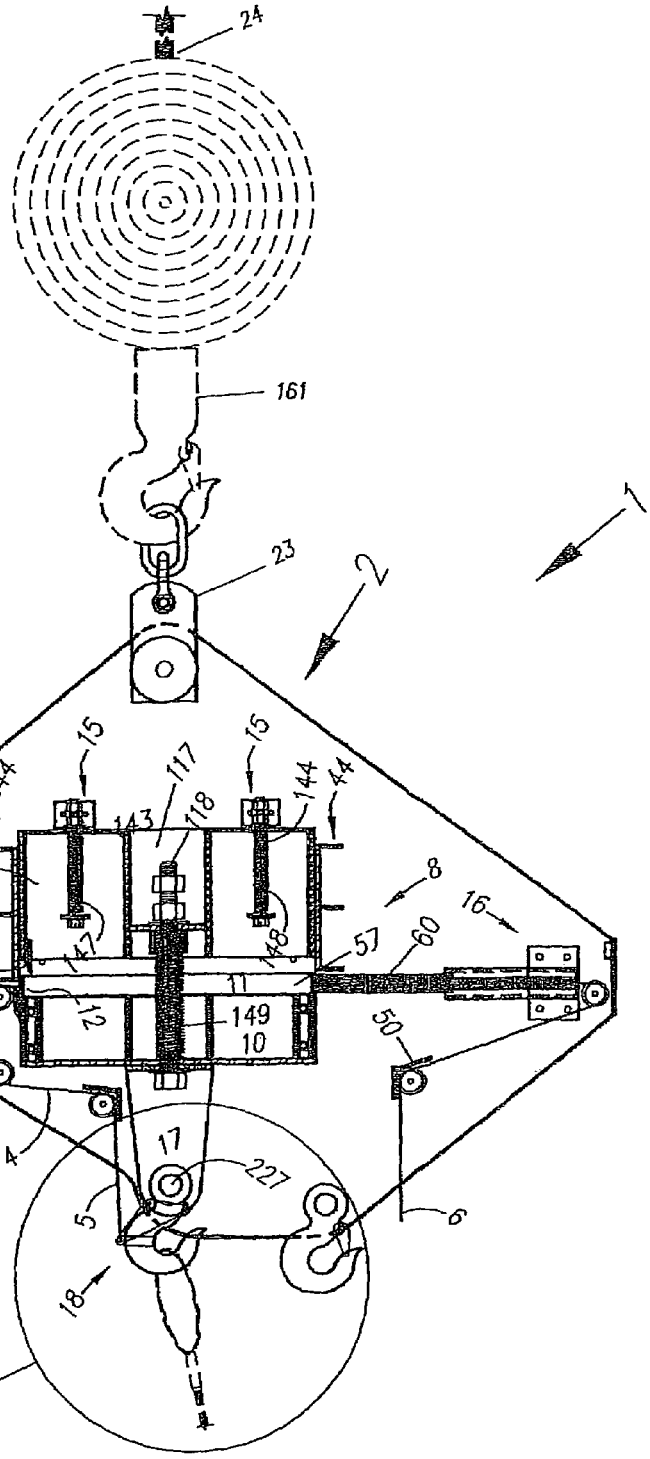
FIG. 14 is a view of a preferred embodiment of the invention with the front plate of the housing removed, illustrating the positions of the various elements relative to one another when the sling hook is ready to receive a load.

As illustrated in more detail in FIGS. 6-12, the load-activated lock assembly 8 includes a support structure 10 fixed to housing 2. As depicted by FIGS. 6, 7, and 14, it also includes a latch activating member 11 having a keyhole 12. Latch activating member 11 is positioned in housing 2 to slide on support structure 10. It further includes movable structure 13 positioned adjacent latch activating member 11 and provided with key member 14 sized and shaped to be inserted into keyhole 12. It also includes a mounting assembly 15 fixed to housing 2 and attachable to movable structure 13 in a manner to permit vertical movement of movable structure 13 within housing 2. Also included as part of load-activated lock assembly 8 is compression spring assembly 16 operatively attached to latch activating member 11 to position latch activating member 11 when no force is applied to load release line 6. Finally, positioned beneath support structure 10 is latch attachment assembly 17. It forms part of load-activated lock assembly 8 and is attached to load-engaging assembly 3 and to movable structure 13 in a manner to permit movable structure 13 to be forced sufficiently downward to position key member 14 into keyhole 12 when a load placed on sling hook 53 is lifted above the ground.

Figure 3:
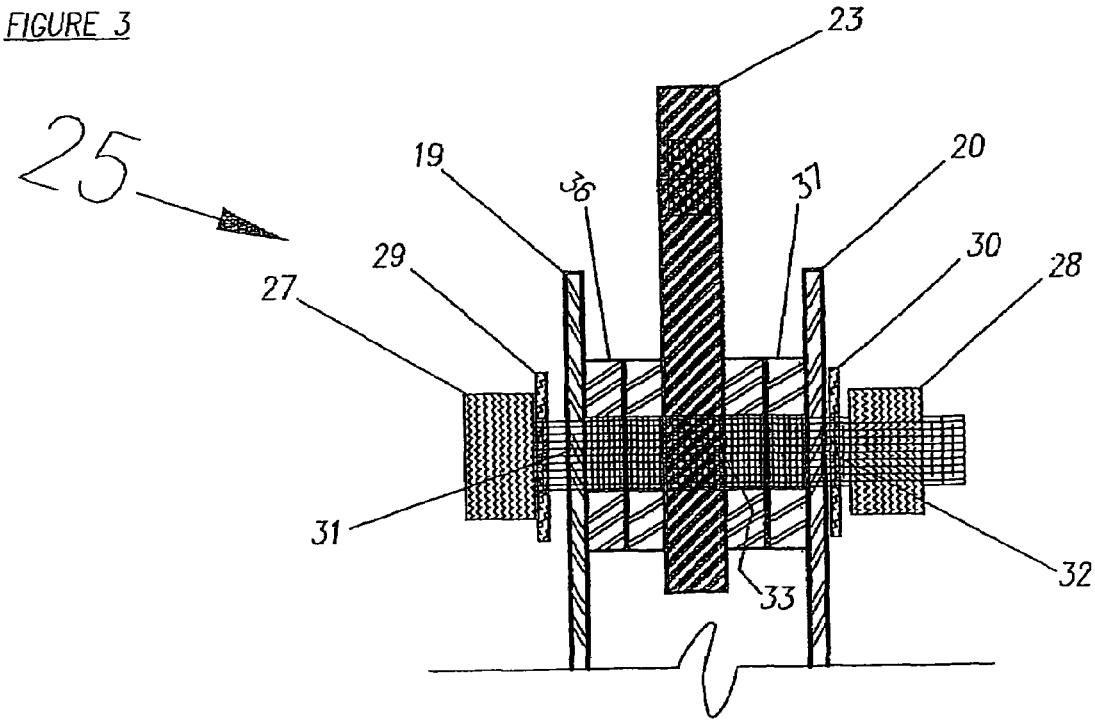
FIG. 3 is a cross sectional view taken along section lines 3-3 of FIG. 2, depicting how the housing plates are operatively joined at this point.
Figure 4:
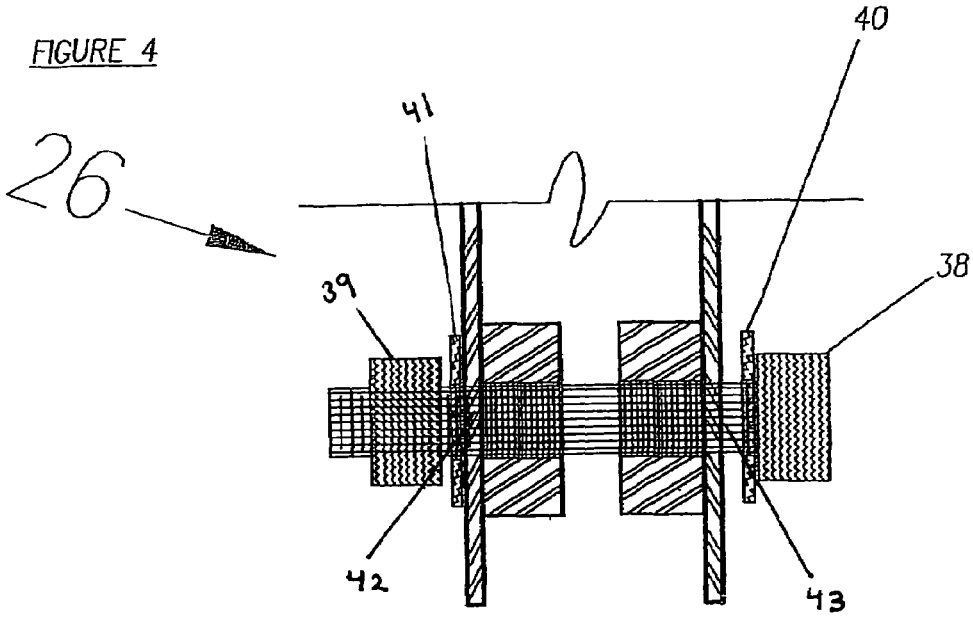
FIG. 4 is a cross sectional view taken along section lines 4-4 of FIG. 2, depicting how the housing plates are operatively joined at this point.

In a preferred embodiment, and as depicted by FIG. 2, housing spacer plate 21 is provided with a slotted opening 22 to permit load release line 6 to be pulled in a horizontal fashion to release attached load 7, as further described below. A hoist crane hook attachment device 23, to operatively engage housing 2 to a crane lift line 24, is positioned between plates 19 and 20. Front plate 19 and back plate 20 are operatively joined to each other at various points in such a manner so as to preserve their parallel integrity. These attachment points are further discussed below. As illustrated in FIGS. 3 and 4, at two points, plates 19 and 20 are fixed in position by upper bolt assembly 25, and lower bolt assembly 26. Upper bolt assembly 25 comprises bolt 27, lock nut 28, and locking washers 29 and 30. Bolt 27 has sufficient length to extend through aligned upper openings 31 and 32 in plates 19 and 20, respectively, as well as through opening 33 provided to hoist crane sling hook attachment device 23. It is preferred that locking washers 29 and 30 are positioned on bolt 27 to contact plate exterior surfaces 34 and 35 when lock nut 28 is screwed onto bolt 27 and tightened. In a preferred embodiment, interior surface 162 of front plate 19 and interior surface 163 of back plate 20 have thickened shoulders 36 and 37, respectively, to distribute the weight of lifted load 7 so as to preserve the integrity of bolt 27. Lower bolt assembly 26 comprises bolt 38, locking washers 40 and 41, and lock nut 39. Bolt 38 has a diameter and length to permit it to extend through aligned lower openings 42 and 43 of plates 19 and 20 respectively, and is secured via lock nut 39. It is preferred that locking washers 40 and 41 are positioned on bolt 38 to contact plate exterior surfaces 34 and 35 when nut 39 is screwed onto bolt 38 and tightened.

Turning now to FIG. 5, housing 2 further includes the following components. In a preferred embodiment, housing 2 further includes a pair of brackets, 172 and 173, welded to each end of back plate 20. Brackets 172 and 173 extend outwardly from interior surface 163 of back plate 20 and are configured to engage front plate 19 of housing 2, so as to provide another point of parallel attachment for front plate 19 and back plate 20 of housing 2. Housing 2 further includes a guide assembly 44 comprising a pair of E-shaped vertical brackets 45 and 46 welded to interior surface 163 of back plate 20. Brackets 45 and 46 are positioned adjacent to movable structure 13, yet are situated at enough distance from movable structure 13 so as to provide clearance. Brackets 45 and 46, like brackets 172 and 173, are also configured to engage front plate 19 of housing 2, so as to provide another point of parallel attachment for plates 19 and 20. Housing 2 is further provided with a guard latch plate 47, welded to interior surface 163 of back plate 20. Guard latch plate 47 comprises has a slotted opening 190 designed to engage tip end 48 of load-engaging assembly 3, as further described below. Housing 2 is also provided with one or more rotatable pulleys 49 to allow cable 4 to be directed and redirected as desired, and to provide mechanical advantage to the operator. Finally, housing 2 further comprises stop plates 50 welded to interior surface 163 of back plate 20 in appropriate positions to prevent cable 4 from jumping off pulleys 49.

Figure 14A:
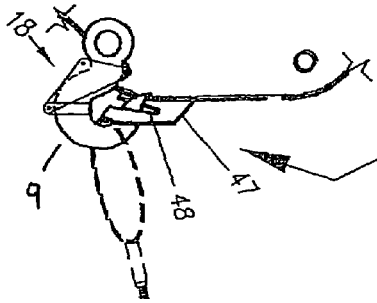
FIG. 14A is an enlarged view of the circled area of FIG. 14, depicting the sling hook engaged to the guard latch.

Turning now to FIGS. 6 and 13, in a preferred embodiment, load-engaging assembly 3 (FIG. 13) comprises a sling hook 53, such as are well known in the industry, and load 7 to be lifted/transported is attached to sling hook 53 via rigging components conventional in the industry, such as slings 54 or chains. Sling hook 53 provides for a universal application as sling hook 53 may be utilized with slings and hardware of various sizes and weights, thereby allowing for a greater variation in the rigging components that can be used in load lift operations. Sling hook 53 further comprises an interior section 55 and a mouth 56 that provides access to interior section 55. In addition, sling hook 53 further comprises tip end 48 designed to be inserted through slotted opening 190 of guard latch plate 47 within housing 2, as shown in FIGS. 2A, 5, and 14A. As depicted by FIG. 14A, this prevents lifting sling 54 from sliding off tip end 48 of sling hook 53 when sling 54 is first applied to sling hook 53, this guard latch 47 feature of the invention thereby maintaining the safety and integrity of lifting sling 54 and hardware. When load 7 is then applied to sling 54, the downward weight of load 7 causes tip end 48 of sling hook 53 to become disengaged from guard latch plate 47, yet at this point, the weight of lifted load 7 is sufficient to keep sling 54 from slipping off tip end 48 of sling hook 53.

Figure 15:
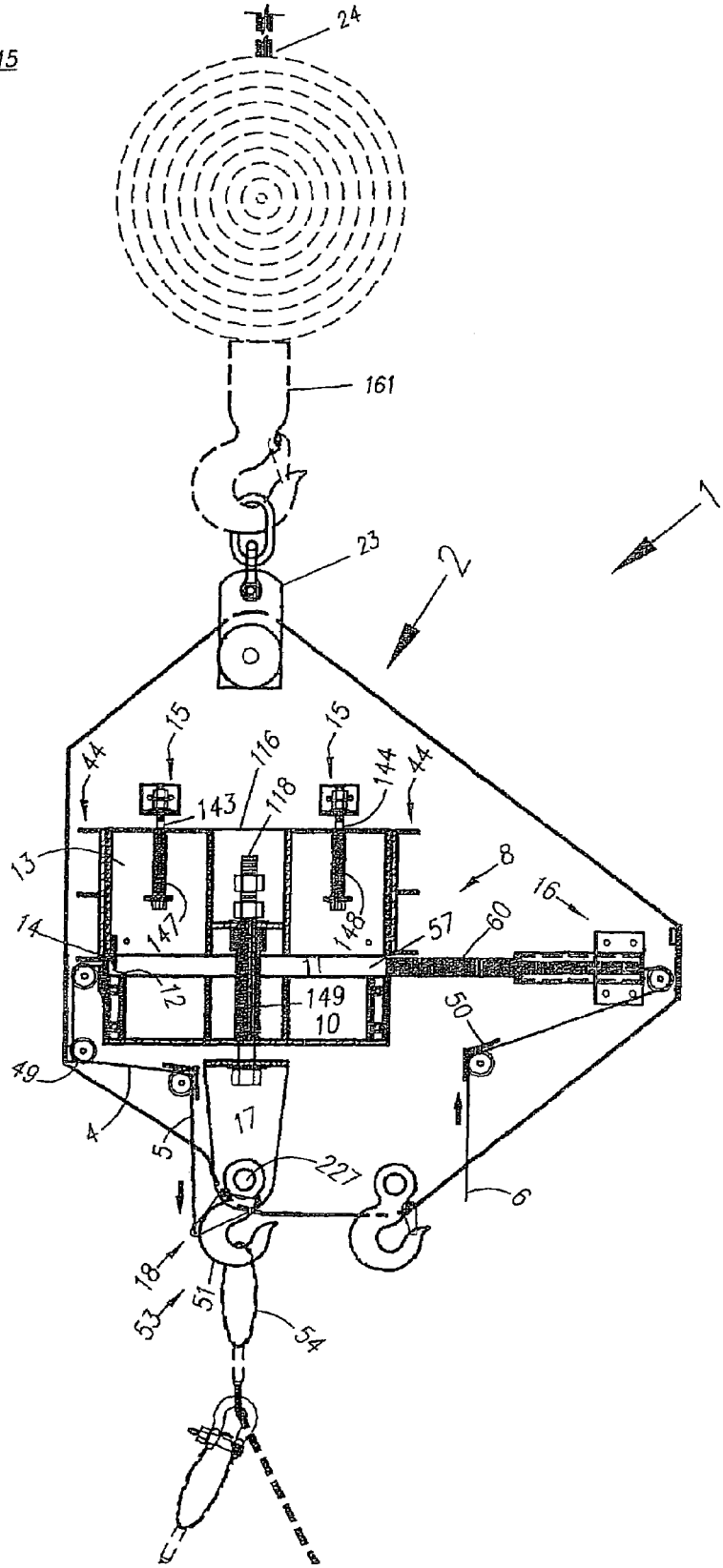
FIG. 15 is a view of a preferred embodiment of the invention with the front plate of the housing removed, illustrating the positions of the various elements relative to one another when the load has been attached to the sling hook via a sling.

As shown in FIGS. 14 and 14A, in a preferred embodiment, sling hook 53 has safe position 9, a loaded position 51, and a released position 52, sling hook 53 being configured to pivot between loaded position 51 and released position 52. As further shown in FIGS. 14 and 14A, sling hook 53 is in safe position 9 when tip end 48 of sling hook 53 is inserted through slotted opening 190 of guard latch plate 47 within housing 2. As shown in FIG. 15, sling hook 53 is in loaded position 51 when mouth 56 of sling hook 53 is situated between housing 2 and interior section 55 of sling hook 53. As shown in FIG.

16, sling hook 53 is in released position 52 when interior section 55 of sling hook 53 is at least about level with mouth 56, or when interior section 55 is above mouth 56.

Figure 16:
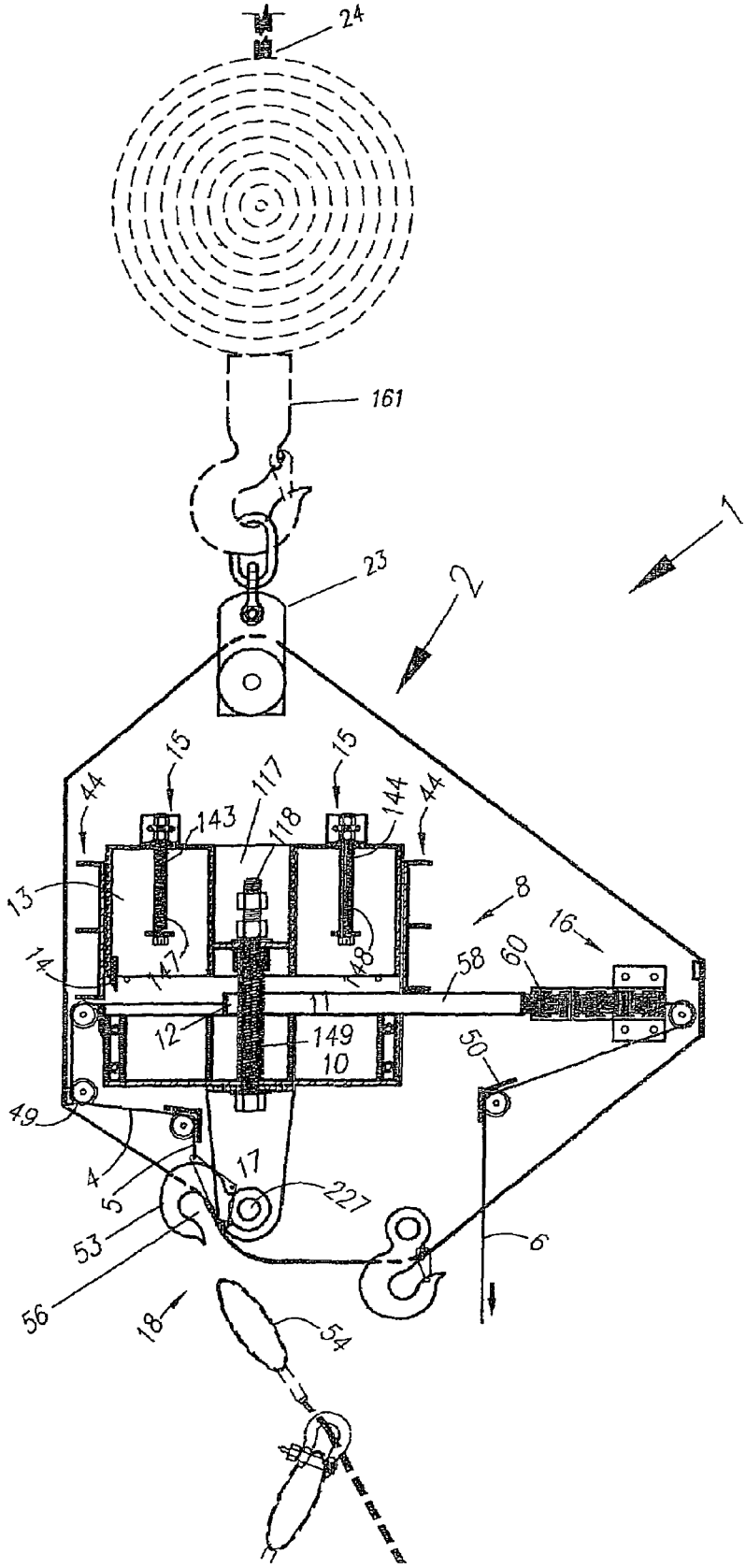
FIG. 16 is a view of a preferred embodiment of the invention with the front plate of the housing removed, illustrating the positions of the various elements relative to one another when the load has been transported to the desired location and positioned at the final anchor location and released.

As shown in FIGS. 1 and 2, cable 4 of apparatus 1 includes a load end 5 operatively attached to sling hook 53 via unlatching trigger assembly 18, as further discussed below. Cable 4 further includes a load release line 6, situated outside housing 2, for unlatching load 7 attached to sling hook 53. In a preferred embodiment, cable 4 has a first position 57, as shown in FIGS. 14 and 15, and a second position 58, as shown in FIG. 16. Cable 4 is configured so that when a linear force is exerted on load release line 6 of cable 4, cable 4 is moved from first position 57, as shown in FIGS. 14 and 15, to second position 58, as shown in FIG. 16. Cable 4 is further configured so that a linear force exerted on load release line 6 of cable 4 is also transmitted to unlatching trigger assembly 18, which then pivots sling hook 53 from loaded position 51, as shown in FIG. 15, to released position 52, as shown in FIG. 16. Thus, cable 4 and sling hook 53 are configured such that when a linear force is exerted on load release line 6, cable 4 is moved from first position 57 to second position 58, whereby sling hook 53 is moved from loaded position 51 to released position 52. In a preferred embodiment, cable 4 is biased against movement into second position 58 such that when the linear force exerted upon load release line 6 ceases, cable 4 returns to first position 57, allowing sling hook 53 to pivot to loaded position 51 via gravity. This bias can be achieved via compression spring assembly 16 affixed to latch activating member 11.

Figure 10A:
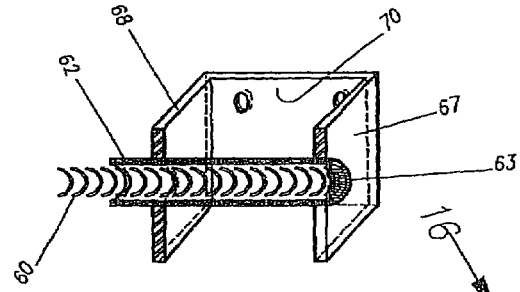
FIG. 10A is a cross sectional view of the compression spring assembly taken along section lines 10A-10A of FIG. 10.
Figure 10:
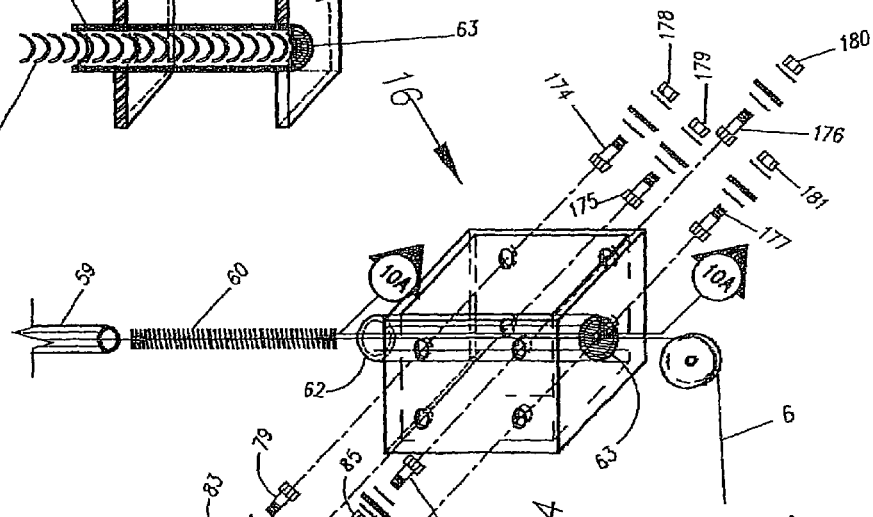
FIG. 10 is a three-quarter perspective and partial exploded view of the compression spring assembly.
Figure 10B:
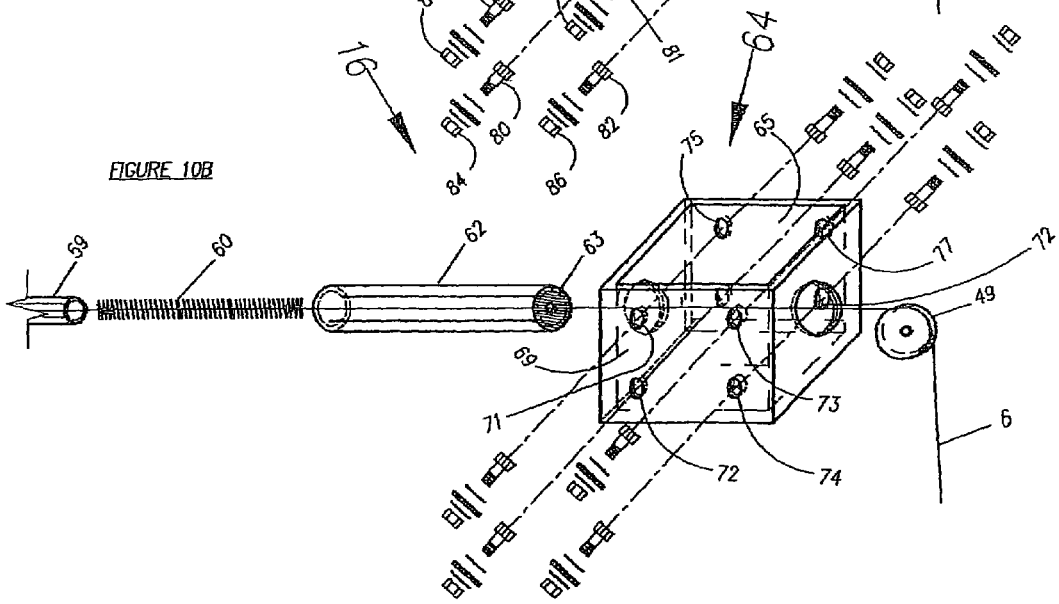
FIG. 10B is a three-quarter perspective and partially exploded view similar to FIG. 10, but with the sleeve member of the compression spring assembly exploded outside the anchor box.

As shown in FIGS. 6, 10, and 10A, compression spring assembly 16 includes a tubular insert guide member 59 operatively attached to extremity of latch activating member 11. Latch activating member 11, in turn, is affixed to cable 4 and is configured to slidably move within housing 2 with cable 4 from first position 57, as shown in FIGS. 14 and 15, to second position 58, as shown in FIG. 16. Turning now to FIGS. 10 and 10A, tubular insert guide member 59 attached to latch activating member 11 is hollow and includes a biasing spring 60 running through length of tubular insert guide member 59. Biasing spring 60 should be positioned and configured to be compressed, or alternatively, expanded, as cable 4 and latch activating member 11 are moved from first position 57 to second position 58, upon the application of a linear force to load release line 6 of cable 4. When the linear force on load release line 6 of cable 4 ceases, biasing spring 60 should relax and return cable 4 and latch activating member 11 to first position 57, allowing sling hook 53 to pivot to loaded position 51 via gravity. Thus, in this fashion, biasing spring 60 of compression spring assembly 16 biases cable 4 against movement into second position 58 and tubular insert guide member 59 serves to guide spring 60 upon its compression/or expansion and subsequent relaxation. In a preferred embodiment, line transfer spring assembly 16 further comprises a sleeve member 62 having an end plate 63, sleeve member 62 being positioned to receive tubular insert guide member 59 containing biasing spring 60. Sleeve member 62 and end plate 63 are configured to check the compression/or expansion of spring 64 upon application of linear force to load release line 6 of cable 4. Sleeve member 62, in turn, extends into a spring sleeve anchor box 64, where it ultimately affixed. Spring sleeve anchor box 64 is hollow and generally square in shape and comprises a top plate 65, a bottom plate 66, two side plates 67 and 68, a front plate 69 and a back plate 70. Front plate 69 and back plate 70 of spring sleeve anchor box 64 are in parallel alignment with front plate 19 and back plate 20 of housing 2, respectively, and back plate 70 of spring sleeve anchor box 64 is bolted to interior surface 163 of back plate 20 of housing 2, as depicted in FIG. 5, and as further described below.

As shown in FIG. 10, front plate 69 of spring sleeve anchor box 64 has four openings 71, 72, 73, and 74 in alignment with four openings 75, 76, 77 and 78 provided to back plate 70 of spring sleeve anchor box 64. Front plate 19 and back plate 20 of housing 2 are both provided with openings corresponding to those given front plate 69 and back plate 70 of spring sleeve anchor box 64, respectively. Bolts 79, 80, 81, and 82, having sufficient diameter and length to extend through openings 71, 72, 73, 74 of front plate 69 are driven through front plate 19 of housing 2 and front plate 69 of spring sleeve anchor box 64. Bolts 79, 80, 81, and 82 are secured via lock nuts 83, 84, 85, and 86 respectively. Bolts 174, 175, 176, and 177, having sufficient diameter and length to extend through openings 75, 76, 77, and 78 of back plate 70 are driven through back plate 70 of spring sleeve anchor box 64 and back plate 20 of housing 2. Bolts 174, 175, 176, and 177 are secured via lock nuts 178, 179, 180, and 181, respectively. Thus, spring sleeve anchor box 64 provides another point of attachment for front plate 19 and back plate 20 of housing 2 that maintains their parallel integrity.

As mentioned above, and as shown in FIG. 6, apparatus 1 further comprises load-activated lock assembly 8 having movable structure 13, latch activating member 11, and fixed support structure 10, these embodiments discussed in further detail below.

Figure 11A:
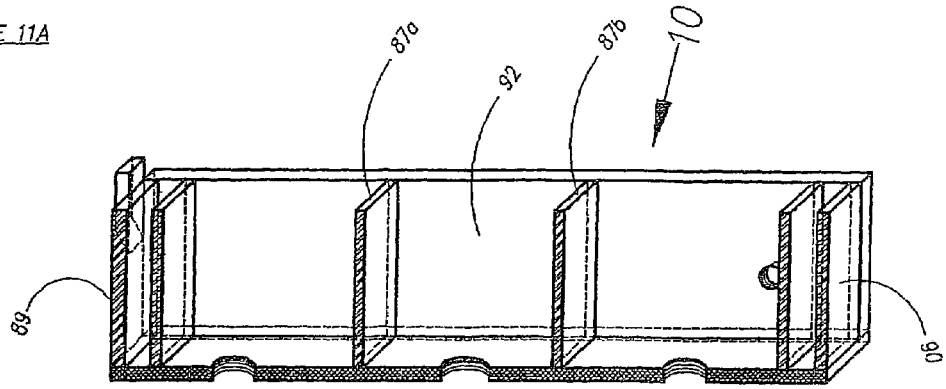
FIG. 11A is a cross sectional view of the fixed support structure taken along section lines 11A-11A of FIG. 11.
Figure 11:
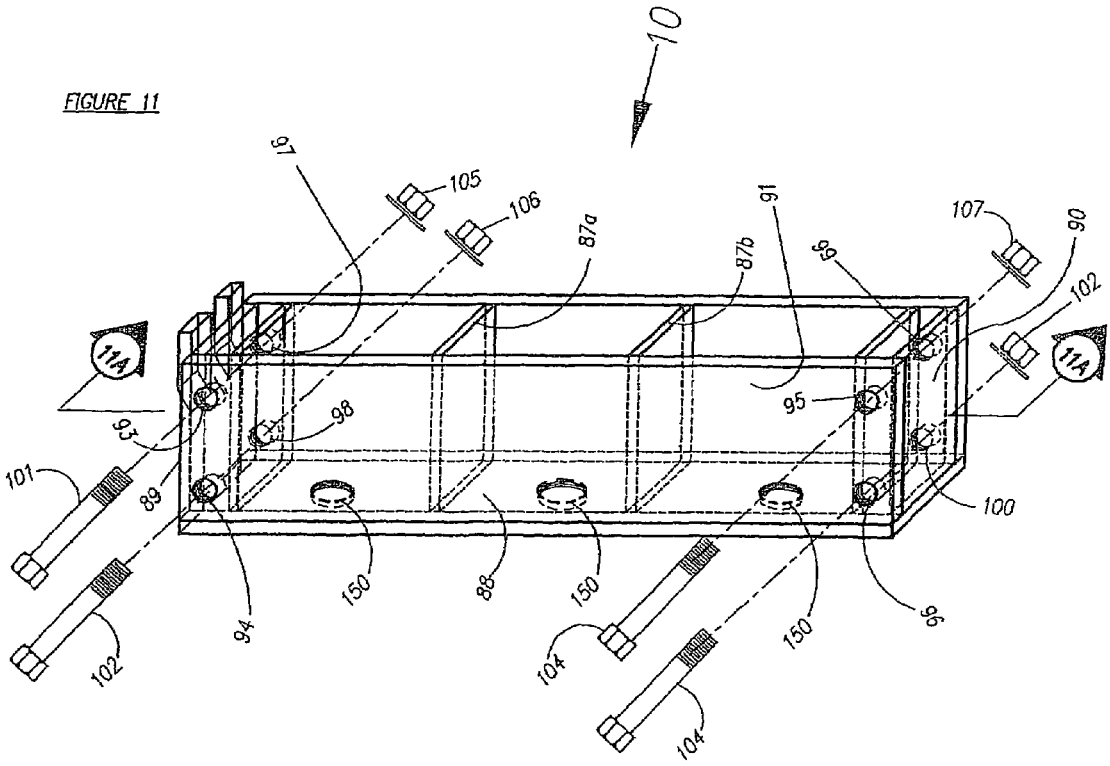
FIG. 11 is an isometric exploded view of the fixed support structure of the load-activated lock assembly.

Turning now to FIGS. 11 and 11A, fixed support structure 10, is generally hollow and rectangular in shape. Fixed support structure 10 comprises a bottom plate 88, two end plates 89 and 90, a front plate 91 and a back plate 92. Fixed support structure 10 is further provided with two stiffener plates 87*a* and 87*b* situated within fixed support structure 10 that maintain the rigidity of fixed support structure 10. Front plate 91 and back plate 92 of fixed support structure 10 are in parallel alignment with front plate 19 and back plate 20 of housing 2, respectively, with back plate 92 of fixed support structure 10 being bolted to interior surface 163 of back plate 20 of housing 2, as depicted in FIG. 5. As shown in FIG. 11, front plate 91 of fixed support structure 10 has four openings 93, 94, 95 and 96 in alignment with four openings 97, 98, 99, and 100 provided to back plate 92 of fixed support structure 10. Front plate 19 and back plate 20 of housing 2 are both provided with openings corresponding to those given front plate 91 and back plate 92 of fixed support structure 10. Bolts 101, 102, 103, and 104 having sufficient diameter and length to extend through openings 93, 94, 95, 96, 97, 98, 99, and 100, are extended through front plate 19 of housing 2, front plate 91 and back plate 92 of fixed support structure 10, and back plate 20 of housing 2, respectively. Bolts 101, 102, 103, and 104 are secured via lock nuts 105, 106, 107, and 108, respectively. Thus, fixed support structure 10 provides another point of parallel attachment for front plate 19 and back plate 20 of housing 2.

As shown in FIG. 6, load-activated lock assembly 8 also includes latch activating member 11 which is configured to rest and slide along the edges of front plate 91 and back plate 92 of fixed support structure 10. As discussed above, latch activating member 11 is affixed to cable 4 between load release line 6 and load end 5, and is configured to move within housing 2 with cable 4 from first position 57, as shown in FIGS. 14 and 15, to second position 58, as shown in FIG. 16. As also discussed previously, and as shown in FIG. 6, latch activating member 11 serves as an attachment point for compression spring assembly 16 which biases cable 4 and latch activating member 11 against movement into second position 58. As will be described further below, latch activating member 11 also serves as a base for movable structure 13 to engage with to secure cable 4 and latch activating member 11 in first position 57. Latch activating member 11 comprises two end plates, 167 and 168, a front plate 169, and a back plate 170. Latch activating member 11 is further provided with a stiffener plate 165 situated within latch activating member 11 to maintain the rigidity of latch activating member 11. Latch activating member 11 is preferably hollow and rectangular in shape and has keyhole 12 situated at interior surface 171 of end plate 167. Keyhole 12 is designed to be in engagement with keyhole 14 of movable structure 13, as further discussed below.

Figure 8A:
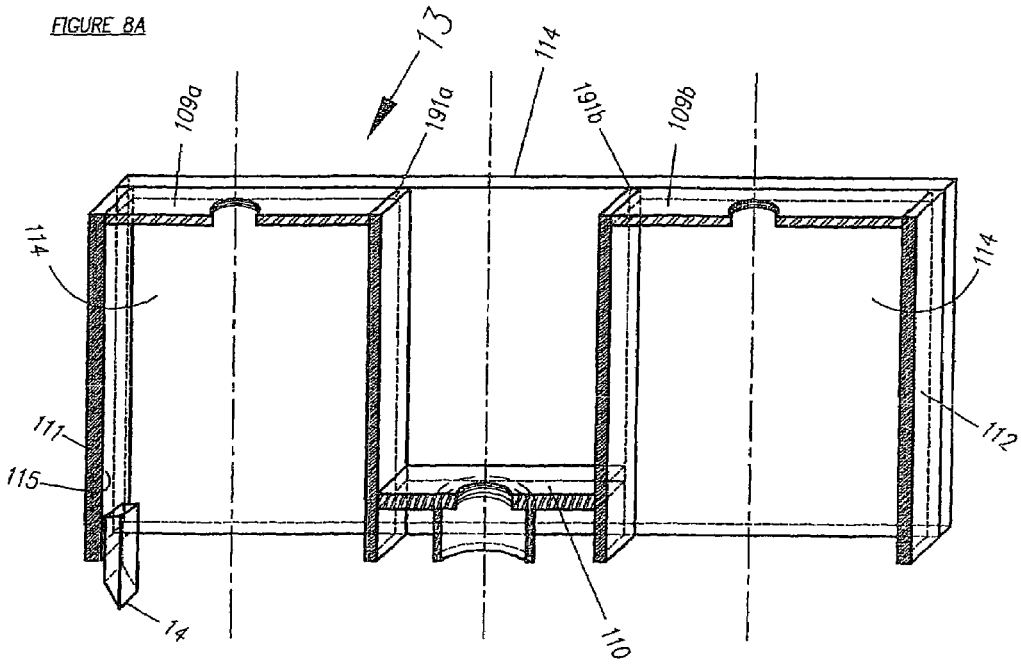
FIG. 8A is cross sectional view of the movable structure taken along section lines 8A-8A of FIG. 8.
Figure 8:
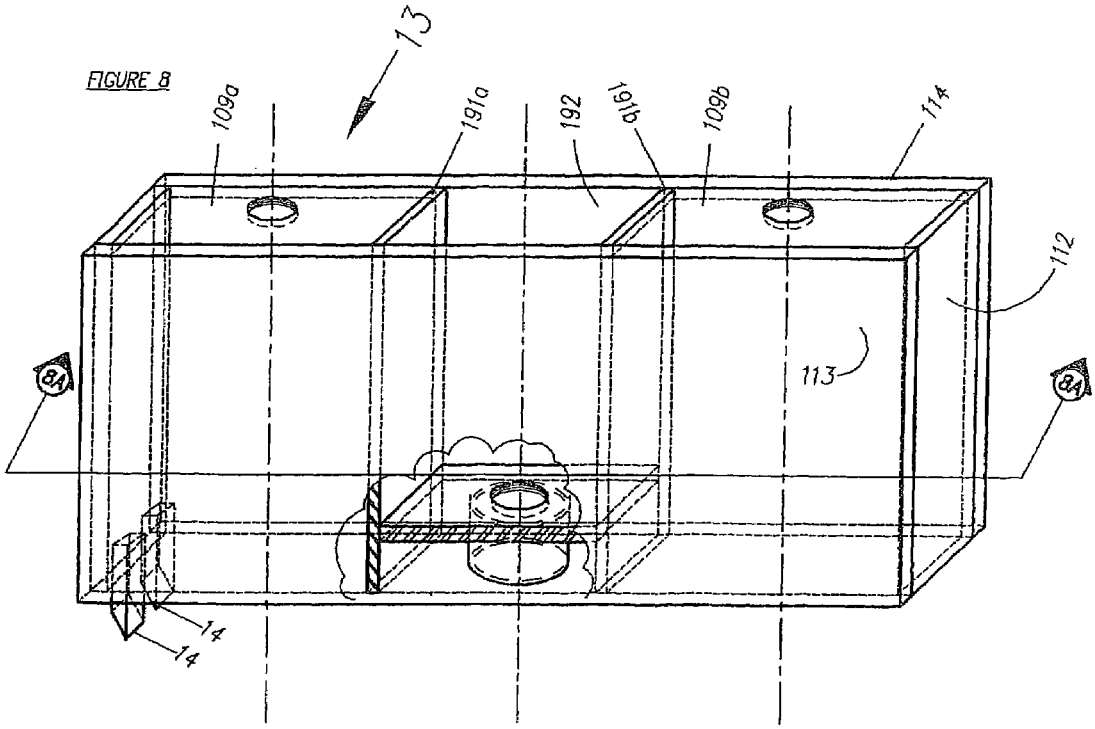
FIG. 8 is a three-quarter perspective view of the movable structure of the load-activated lock assembly.
Figure 9A:
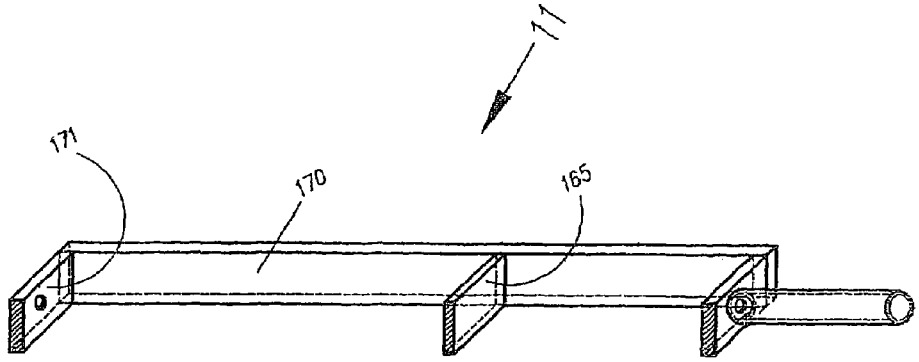
FIG. 9A is a cross sectional view of the latch activating member taken along section lines 9A-9A of FIG. 9.
Figure 9:
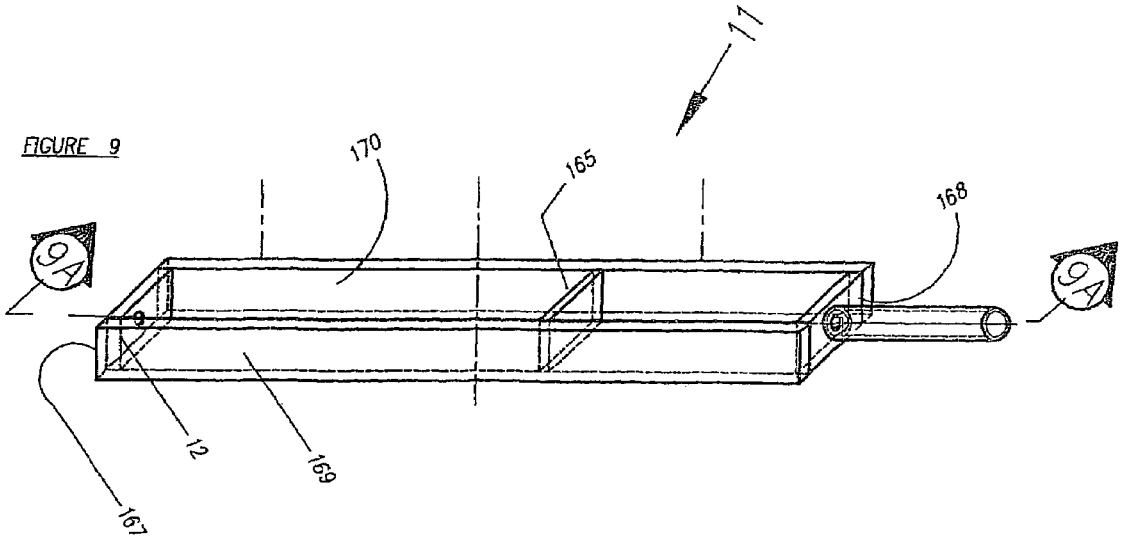
FIG. 9 is a three-quarter perspective view of the latch activating member of the load-activated lock assembly.

As shown in FIG. 6, load-activated lock assembly 8 also includes movable structure 13 that is configured to rest independently on latch activating member 11. Turning now to FIGS. 8 and 8A, movable structure 13 is generally rectangular in shape, and comprises two top plates 109*a* and 109*b* separated by an aperture 192, two end plates, 111 and 112, a front plate 113 and a back plate 114. Front plate 113 and back plate 114 of movable structure 13 are in parallel alignment with front plate 19 and back plate 20 of housing 2, respectively. Movable structure 13 is further provided with two stiffener plates 191*a* and 191*b* situated within movable structure 13 to maintain the rigidity of movable structure 13. Movable structure 13 is further provided with a plate 110 situated toward the lower extremity of movable structure 13. Plate 110 is welded to stiffener plates 191*a* and 191*b*, and front and back plates 113 and 114 of movable structure 13, and is designed to contain a bolt 118, as further described below. Movable structure 13 further comprises key 14 affixed to interior wall surface 115 of end plate 111, key 14 being designed to engage keyhole 12 of latch activating member 11. In a preferred embodiment, movable structure 13 has a locked position 116, as depicted in FIG. 15, and an unlocked position 117, as depicted in FIGS. 14 and 16. As shown in FIGS. 6, 14, 15, and 16, movable structure 13 is in mechanical communication with sling hook 53 so that when the vertical force of lifted load 7 is applied to sling hook 53, this force is also transmitted to movable structure 13 to move it from unlocked position 117 to locked position 116. In a preferred embodiment, movable structure 13 is in mechanical communication with sling hook 53 via a bolt 118 housed in plate 110, bolt 118 being operatively secured within movable structure 13 via lock nut 164. As shown in FIG. 6, bolt 118 should be configured to run vertically through movable structure 13, latch activating member 11, support structure 10, and latch attachment assembly 18, respectively, so that when a vertical force is applied to sling hook 53, bolt 118 pulls movable structure 13 toward latch activating member 11, whereby key 14 within movable structure 13 lockingly engage keyhole 12 of latch activating member 11, when cable 4 and latch activating member 11 are in first position 57. Plate 110 housing bolt 118 is configured and positioned to brace bolt 118 and provide a central axis so that when vertical force is applied to sling hook 53, bolt 118 pulls movable structure 13 downward in a stable and linear fashion. Furthermore, vertical E-shaped brackets 45 and 46, situated adjacent to movable structure 13, as described above, also guide movable structure 13 for a proper engagement with latch activating member 11. Thus, as shown in FIG. 15, when movable structure 13 is in locked position 116, key 14 of movable structure 13 engage keyhole 12 of latch activating member 11 to secure cable 4 and latch activating member 11 in first position 57. In unlocked position 117, as shown in FIGS. 14 and 16, key 14 of movable structure 13 disengage keyhole 12 of latch activating member 11, whereby cable 4 and latch activating member 11 are released and may be freely moved between first position 57 and second position 58 upon application of linear force to load release line 6 of cable 4. However, when movable structure 13 is in locked position 116, any linear force exerted on load release line 6 of cable 4 that would otherwise move cable 4 and latch activating member 11 from first position 57 to second position 58 and would thereby move sling hook 53 from loaded position 51 to released position 52 will be opposed by the engagement of movable structure 13 to cable 4 via latch activating member 11. Therefore, if load release line 6 of cable 4 is accidentally or inadvertently pulled when load 7 is suspended from sling hook 53, the engagement of movable structure 13 with latch activating member 11 will prevent sling hook 53 from pivoting to released position 52 and thereby releasing load 7 prematurely. Thus, the lock mechanism of the invention is designed to provide optimum safety for both personnel and equipment during load-lift operations.

In a preferred embodiment, movable structure 13 is biased against movement from unlocked position 117 to locked position 116, so that when load 7 is released from sling hook 53, movable structure 13 will return to unlocked position 117, whereby cable 4 and latch activating member 11 will then be free to be moved from first position 57 to second position 58 by the application of a linear force to load release line 6 of cable 4. This bias can be achieved by mounting assembly 15, which both provides a point of attachment for plates 19 and 20 of housing 2 and biases movable structure 13 against movement from unlocked position 117 to locked position 116, as discussed below.

As shown in FIGS. 6 and 7, leveler assembly 15 includes a pair of brackets 119 and 120 situated on top plates 109*a* and 109*b*, respectively of movable structure 13. Bracket 119 has a base 121, a front plate 122, a side plate 193, and a back plate 123. Front plate 122 and back plate 123 of bracket 119 are in parallel alignment with front plate 19 and back plate 20 of housing 2. Bracket 120 also has a base 124, a front plate 125, a side plate 194, and a back plate 126. Front plate 125 and back plate 126 of bracket 120 are also in parallel alignment with front plate 19 and back plate 20 of housing 2. Back plate 123 of bracket 119 and back plate 126 of bracket 120 are bolted to interior surface 163 of back plate 20 of housing 2, as depicted in FIG. 5. As shown in FIG. 7, front plate 122 of bracket 119 has two openings 127 and 128 in alignment with two openings 129 and 130 provided to back plate 123 of bracket 119. Front plate 125 of bracket 120 also has two openings 131 and 132 in alignment with two openings 133 and 134 provided to back plate 126 of bracket 120 corresponding to those given front plate 122 and back plate 123 of bracket 119 and to those given front plate 125 and back plate 126 of bracket 120. Bolts 135 and 136 having sufficient diameter and length to extend through openings 127 and 128 of front plate 122 are driven through front plate 19 of housing 2 and front plate 122 of bracket 119 respectively, and are secured via lock nuts 139 and 140, respectively. Bolts 137 and 138 having sufficient diameter and length to extend through openings 129 and 130 of back plate 123 are driven through back plate 123 of bracket 119 and back plate 20 of housing 2, respectively, and are secured via lock nuts 141 and 142, respectively. Bolts 182 and 183, having sufficient diameter and length to extend through openings 131 and 132 of front plate 125 are driven through front plate 19 of housing 2 and front plate 125 of bracket 120, respectively, and are secured via lock nuts 184 and 185, respectively. Bolts 186 and 187 having sufficient diameter and length to extend through openings 133 and 134 of back plate 126 are driven through back plate 126 of bracket 120 and back plate 20 of housing 2, respectively, and are secured via lock nuts 188 and 189, respectively. Thus, leveler assembly 15 provides another point of parallel attachment for front plate 19 and back plate 20 of housing 2.

Leveler assembly 15 also serves to bias movable structure 13 against movement from unlocked position 117 to locked position 116. As shown in FIGS. 6 and 7, this is achieved by extending two bolts 143 and 144 through bases 121 and 124 of brackets 119 and 120, respectively. Bolts 143 and 144 are then secured via lock nuts 145 and 146. Bolts 143 and 144 extend into movable structure 13 and operatively join movable structure 13 to brackets 119 and 120 of leveler assembly 15. The biasing is then achieved by providing bolts 143 and 144 with biasing springs 147 and 148, slidably disposed about bolts 143 and 144, respectively. If additional biasing means are desired, then bolt 118, which serves as a mechanical communication between movable structure 13 and sling hook 53, may also be provided with a biasing spring 149. Biasing springs 147, 148, and 149 should be positioned and configured to be compressed, or alternatively expanded, as movable structure 13 is moved from unlocked position 117 to locked position 116 by the application of load 7 to sling hook 53, as depicted in FIG. 15. In a preferred embodiment, bottom plate 88 of fixed support structure 10, is provided with two openings 150 and 151 through which tension of biasing springs 147 and 148 may be adjusted. The amount of tension in biasing springs 147 and 148 will determine the weight of load 7 necessary to pull movable structure 13 toward latch activating member 11 for a locking engagement that will secure cable 4 and latch activating member 11 in first position 57. This adjustable tension feature of load-activated lock assembly 8 allows lock 8 to accommodate the weight of slings 54 and hardware utilized to attach load 7 to apparatus 1, so that only the application of the desired load weight to sling hook 53 will trigger movable structure 13 to move from unlocked position 117 to locked position 116 and a premature locking will thereby be avoided. When load 7 is released from sling hook 53, biasing springs 147, 148, and 149 should then relax and return movable structure 13 to unlocked position 117, freeing cable 4 and latch activating member 11 to be moved to second position 58, as depicted in FIG. 16. Thus, in this fashion, biasing springs 147, 148, and 149 maintain movable structure 13 in unlocked position 117 when there is no load 7 on sling hook 53. At this point, load release line 6 of cable 4, situated outside of housing 2, may be pulled in a vertical fashion. Alternatively, cable 4 may be pulled in a horizontal fashion by extending cable 4 outward through slotted opening 22 of spacer plate 21. Upon application of linear force to load release line 6, cable 4 and latch activating member 11 are moved to second position 58, whereby sling hook 53 is then moved to released position 52, causing sling 54, via which load 7 is attached to sling hook 53, to be quickly and efficiently released from sling hook 53. Thus, as there is no need for personnel to travel to the top of lifted load 7 to detach sling 54, the release mechanism of the invention is designed to reduce the amount of work needed to be performed at elevations above ground level, where there is risk of fall hazards. This, in turn enhances safety and reduces the time and cost concerns associated with such load-lift operations.

Figure 12:
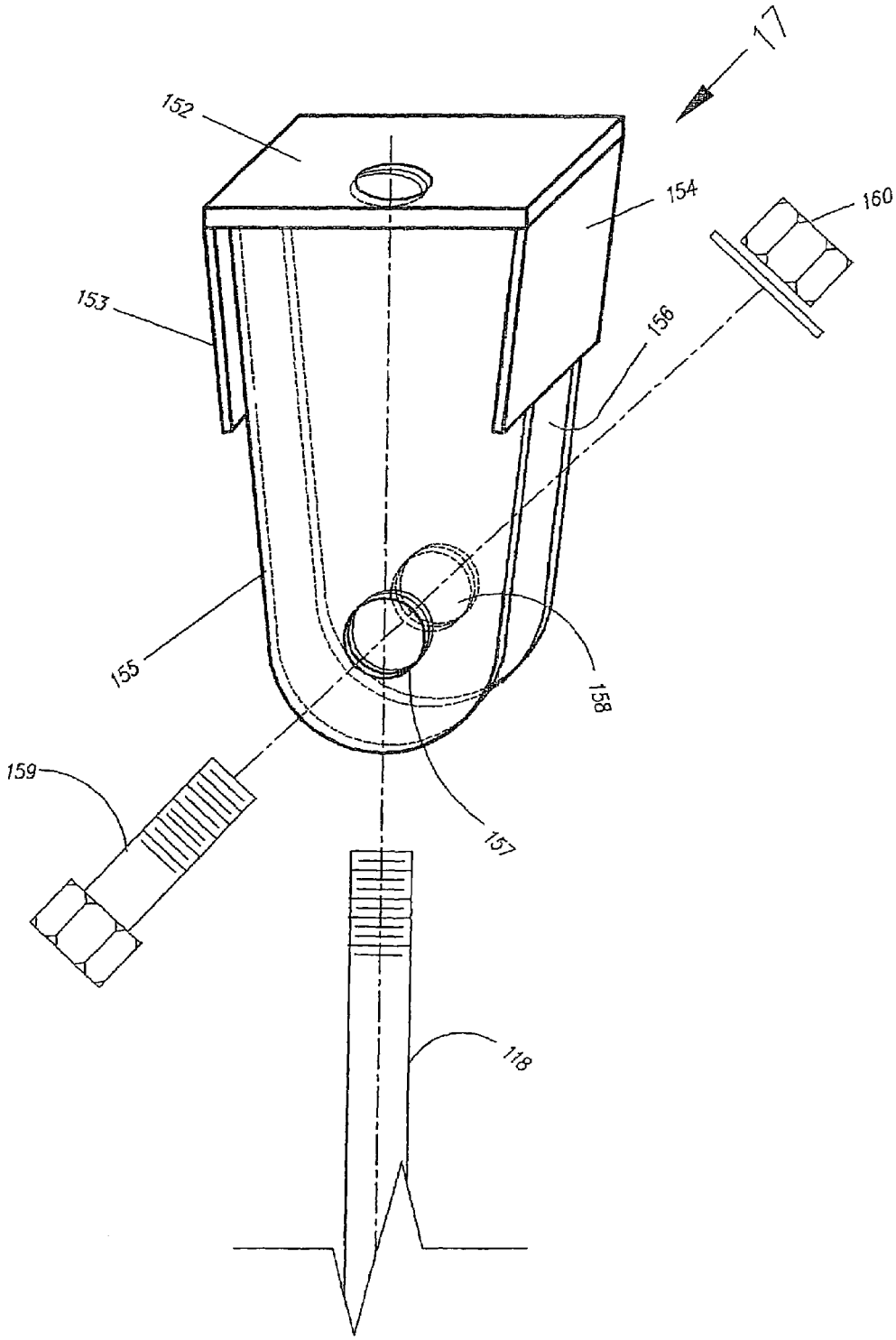
FIG. 12 is an isometric exploded view of the latch attachment assembly.

As shown in FIGS. 6 and 12, apparatus 1 of this invention, further includes latch attachment assembly 17. Latch attachment assembly 17 is situated beneath fixed support structure 10 and comprises a top plate 152, two side plates 153, 154, a front plate 155 and a back plate 156. Front plate 155 and back plate 156 of latch attachment assembly 17 are in parallel alignment with front plate 19 and back plate 20 of housing 2, respectively. Front plate 155 of latch attachment assembly 17 has opening 157 in alignment with opening 158 provided to back plate 156 of latch attachment assembly 17. Bolt 159 of sufficient diameter and length to extend through openings 157 and 158 is driven through front plate 155 and back plate 156 of latch attachment assembly 17 and is secured via lock nut 160. As shown in FIGS. 14, 15, and 16, sling hook 53 is affixed to latch attachment assembly 17 at hinge point 227.

As shown in FIGS. 6, and 13, apparatus 1 further includes unlatching trigger assembly 18. Unlatching trigger assembly 18 comprises triangular shaped plate 199 affixed to a collar member 198. As depicted in FIGS. 13, 14, 15, and 16, triangular shaped plate 199 has three points 195, 196, and 197. At point 196, triangular shaped plate 199 is attached to sling hook 53. At point 197 triangular shaped plate 199 is attached to collar member 198, collar member 198 being ultimately affixed to sling hook 53. Point 197 is also an attachment point for load end 5 of cable 4 to allow hook 53 to pivot when cable 4 is moved. (See FIGS. 14-16). As shown in FIG. 16, unlatching trigger assembly 18 functions as follows. When a linear force is applied to load release line 6 of cable 4, sling hook 53 pivots at hinge point 227 to move toward released position 52. Triangular shaped plate 199 of unlatching trigger assembly 18 then provides a lever arm at hinge point 197 to facilitate the pivoting of sling hook 53, from loaded position 51 to released position 52.

Figure 17:
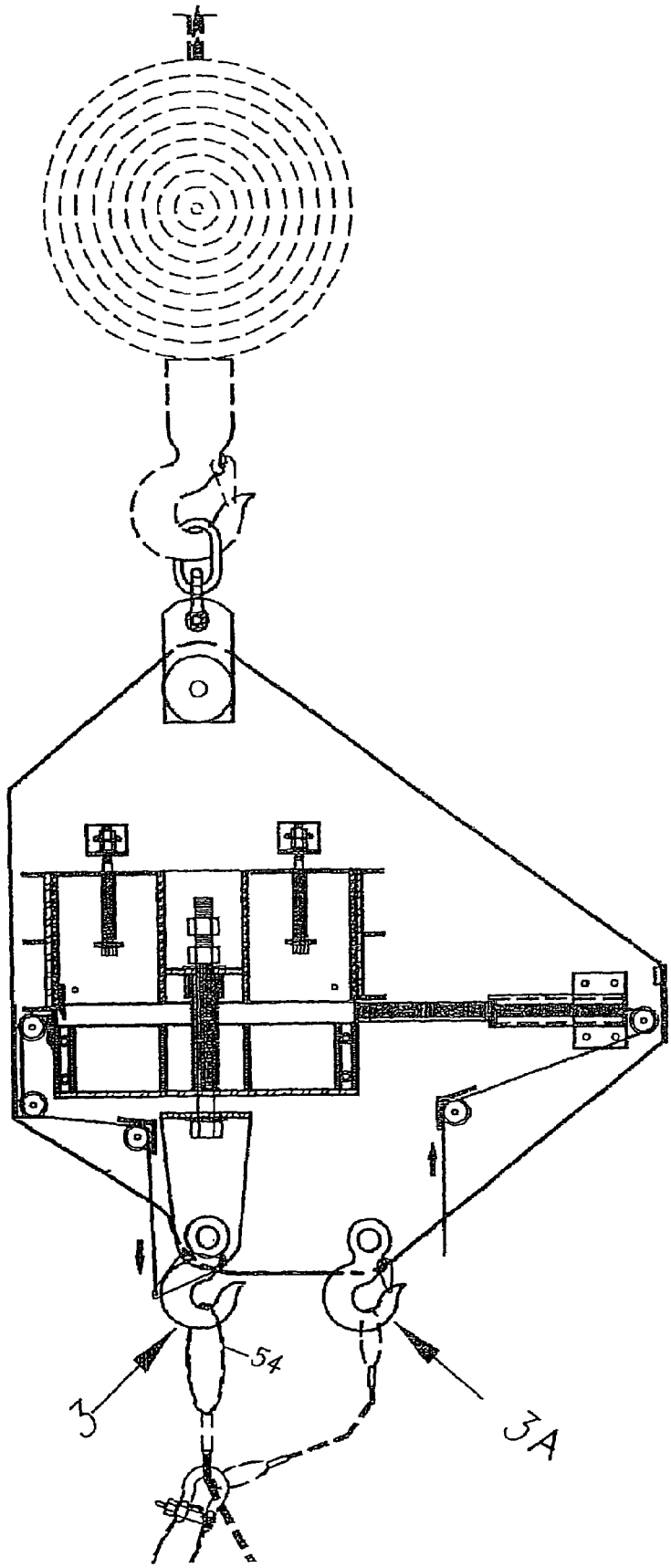
FIGS. 17 and 18 are views of another preferred embodiment of the invention with the front plate of the housing removed, depicting the utilization of a second sling hook in load lift operations.
Figure 18:
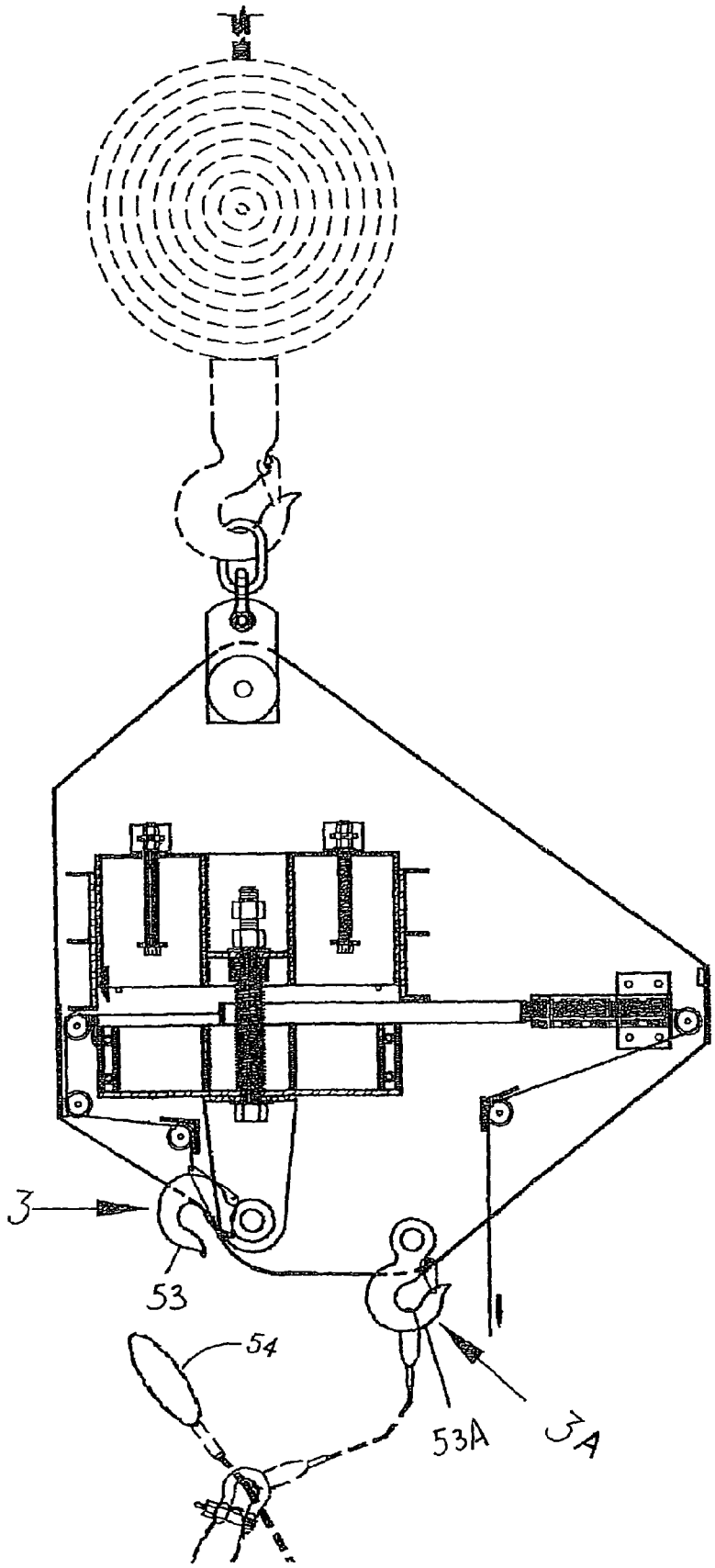
Figure 29:
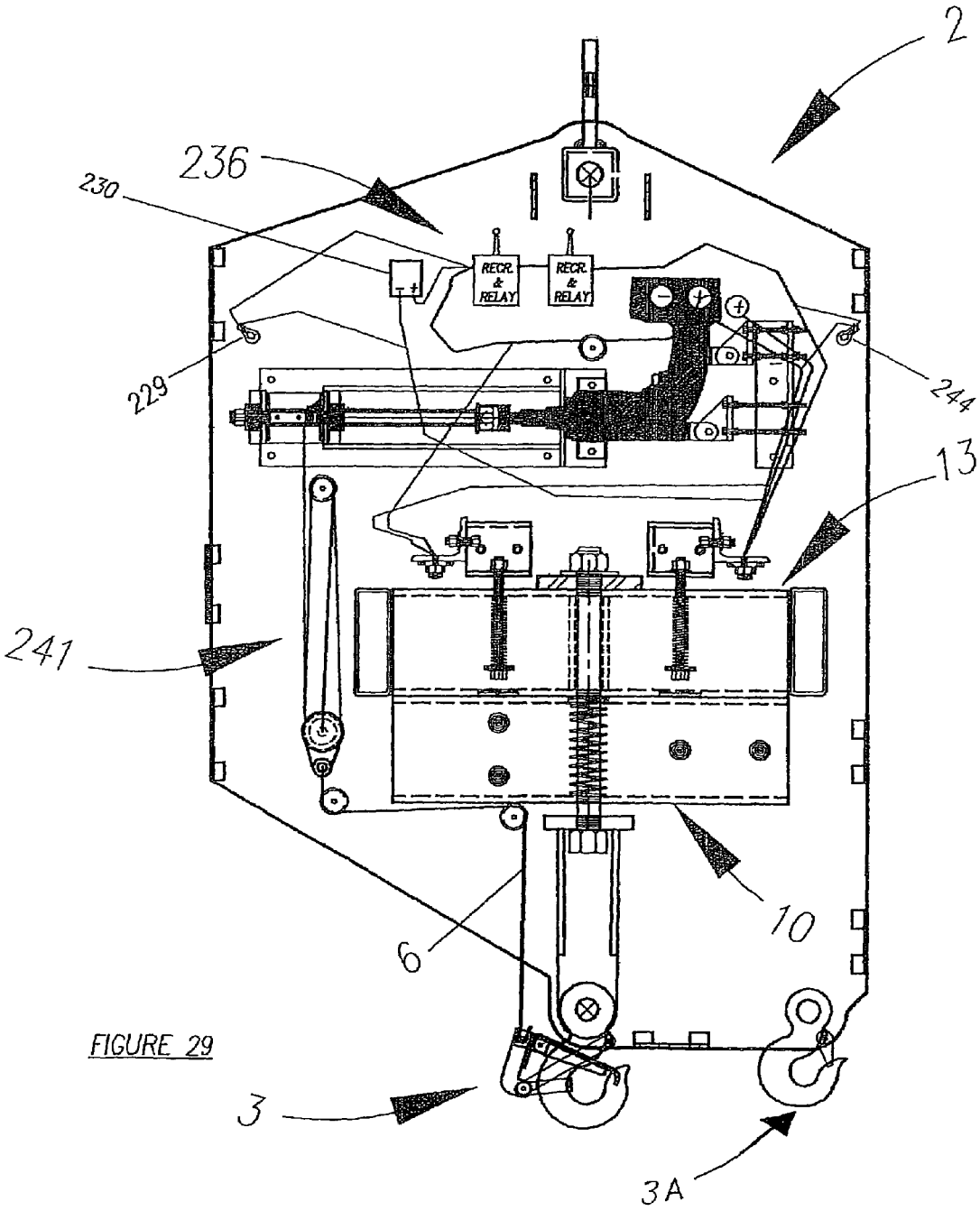
FIG. 29 is an alternate embodiment of the invention wherein the pulley assembly is operatively positioned to directly connect reversible motor reel assembly to the load engaging assembly.

In another preferred embodiment, and as depicted in FIGS. 17, 18, and 29 apparatus 1 comprises a second load-engaging assembly 3A, also preferably a sling hook 53A conventional in the industry. The two-sling hook system of apparatus 1 affords various advantages that provide for an improved apparatus 1. For example, if two sling hooks 53 are utilized, as opposed to one, then the weight of lifted load 7 is distributed across sling hooks 53, thereby resulting in an apparatus 1 that has an increased capacity to lift greater weight. Furthermore, should the conventional cradle hitch rigging method be used, one sling hook 53 can then serve as a releasing mechanism for both load slings 54, whereby slings 54 can then be easily retrieved via a strip choker, well know in the art. In addition, the two-sling hook system of loading apparatus 1 affords an inherent separation feature in that it prevents load slings 54 from entangling, thereby providing for a safer and more efficient load lift operation.

FIG. 14 illustrates the positions of the various elements of the invention relative to one another when sling hook 53 is ready to receive load 7. In this position, housing 2 of the invention is operatively attached to a crane sling hook 161, crane sling hook 161 being ultimately affixed to crane lift line 24. Sling 54, via which load 7 is to be attached to sling hook 53, is then applied to sling hook 53. As depicted, sling hook 53 is in safe position 9, i.e. tip end 48 of sling hook 53 has been inserted into slotted opening 190 of guard latch plate 47 within housing 2 to prevent sling 54 from sliding off tip end 48. As also depicted in FIG. 14, cable 4 and latch activating member 11 are in first position 57 and movable structure 13 is in unlocked position 117.

FIG. 15 illustrates the positions of the various elements of the invention relative to one another when load 7 has been attached to sling hook 53 via sling 54. In this position, lifted load 7 is exerting a downward vertical force upon sling hook 53. This downward force causes tip end 48 of sling hook 53 to become disengaged from guard latch plate 47. As shown, sling hook 53 is now in loaded position 51. At this point only the weight of lifted load 7 upon sling hook 53 is necessary to prevent sling 54 from sliding off tip end 48 of sling hook 53. As shown, the force exerted on sling hook 53 is also being transmitted to movable structure 13, via bolt 118, whereby in locked position 116, key 14 of movable structure 13 engage keyhole 12 of latch activating member 11 to secure cable 4 and latch activating member 11 in first position 57. Therefore, at this point, if load release line 6 of cable 4 were accidentally pulled, movable structure 13 will prevent cable 4 and latch activating member 11 from being moved to second position 58. This in turn will prevent sling hook 53 from being accidentally moved to released position 52 with cable 4 and thereby releasing load 7 prematurely.

FIG. 16 illustrates the position of the various elements of the invention relative to one another when load 7 has been transported to the desired location and positioned at the final anchor location for release. In this position, there is a cessation of the vertical load force upon sling hook 53. This in turn, allows biasing springs 147 and 148 of leveler spring assembly 15, and biasing spring 149, to return movable structure 13 to unlocked position 117, whereby cable 4 and latch activating member 11 are then free to be moved from first position 57 to second position 58. At this point, cable 4 may then be pulled in a vertical fashion or horizontal fashion. When load release line 6 is pulled, cable 4 is moved to second position 58, whereby sling hook 53 is then moved to released position 52, causing sling 54 to be quickly and efficiently released from sling hook 53. When the linear force on load release line 6 of cable 4 ceases, biasing spring 60 of compression spring assembly 16 should relax and return cable 4 and latch activating member 11 to first position 57, allowing sling hook 53 to pivot to loaded position 51 via gravity.

In an another alternative preferred embodiment, the invention further comprises a guard assembly 200. Guard assembly 200 is an additional feature designed to prevent the inadvertent release of sling 54 from sling hook 53. The first feature, guard latch plate 47, was discussed previously. As mentioned above, when sling 54 is first applied to sling hook 53, tip end 48 of sling hook 53 is inserted through slotted opening 190 of guard latch plate 47 to prevent sling 54 from sliding off tip end 48 of sling hook 53. When load 7 is then applied to sling hook 53 via sling 54, load 7 exerts a downward force upon sling hook 53, causing tip end 48 of sling hook 53 to become disengaged from guard latch plate 47, yet at this point, the weight of lifted load 7 is sufficient to keep sling 54 from slipping off tip end 48. In some circumstances, heavier slings, when first applied to sling hook 53 without load 7, may also cause tip end 48 of sling hook 53 to become disengaged from guard latch plate 47. In these instances, although the weight of sling 54 will prevent sling 54 from slipping off tip end 48 of sling hook 53 when sling hook is an upright position, the weight of sling 54 may also cause sling hook 53 to be pushed toward released position 52 prematurely, whereby sling 54 could then slide off tip end 48 of sling hook 53. Guard assembly 200 then is designed to prevent this possible problem.

Figures 19, 19A:
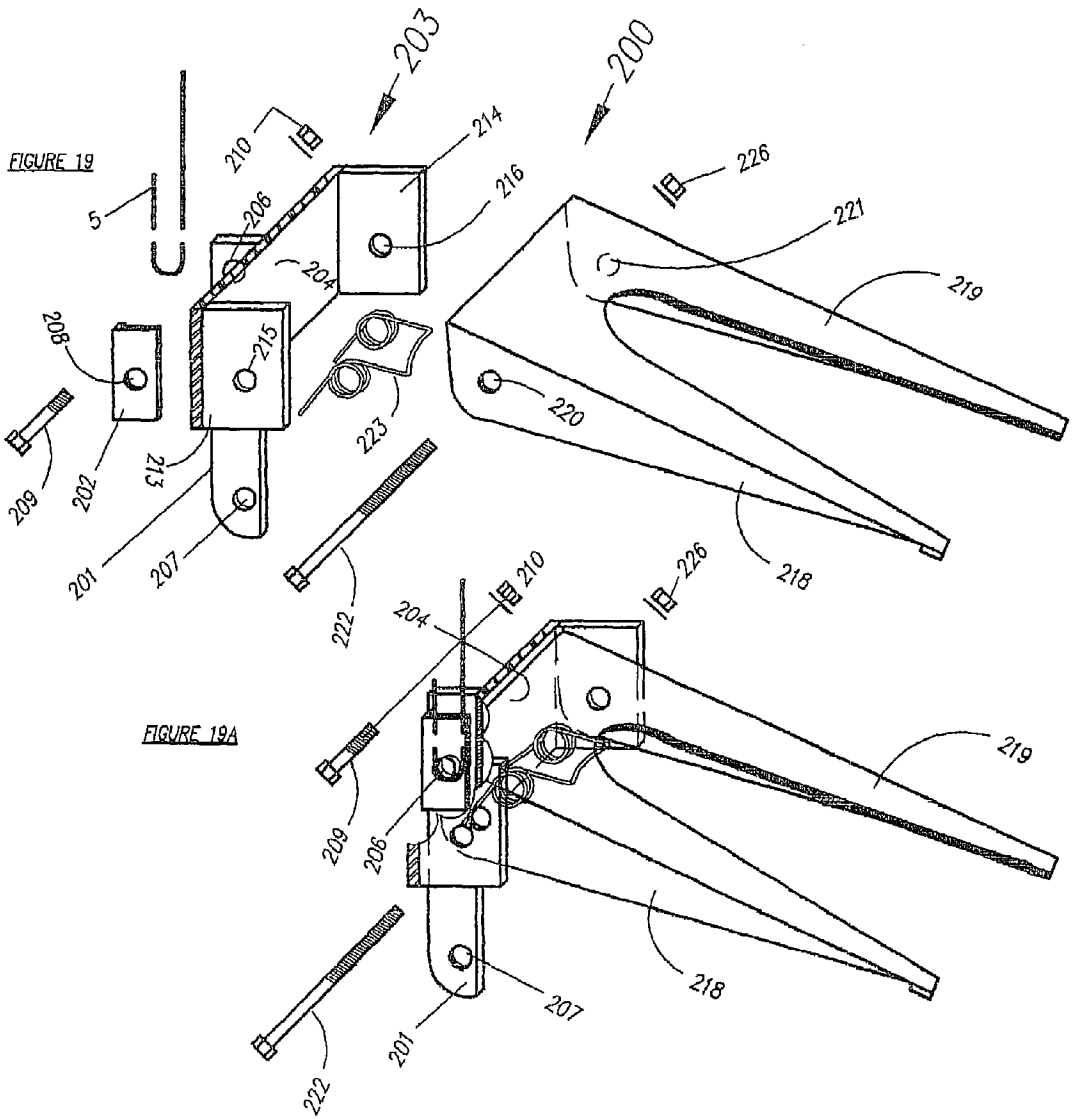
FIG. 19 is an exploded view of the guard assembly.
FIG. 19A depicts the assembly of the guard assembly.
Figure 22:
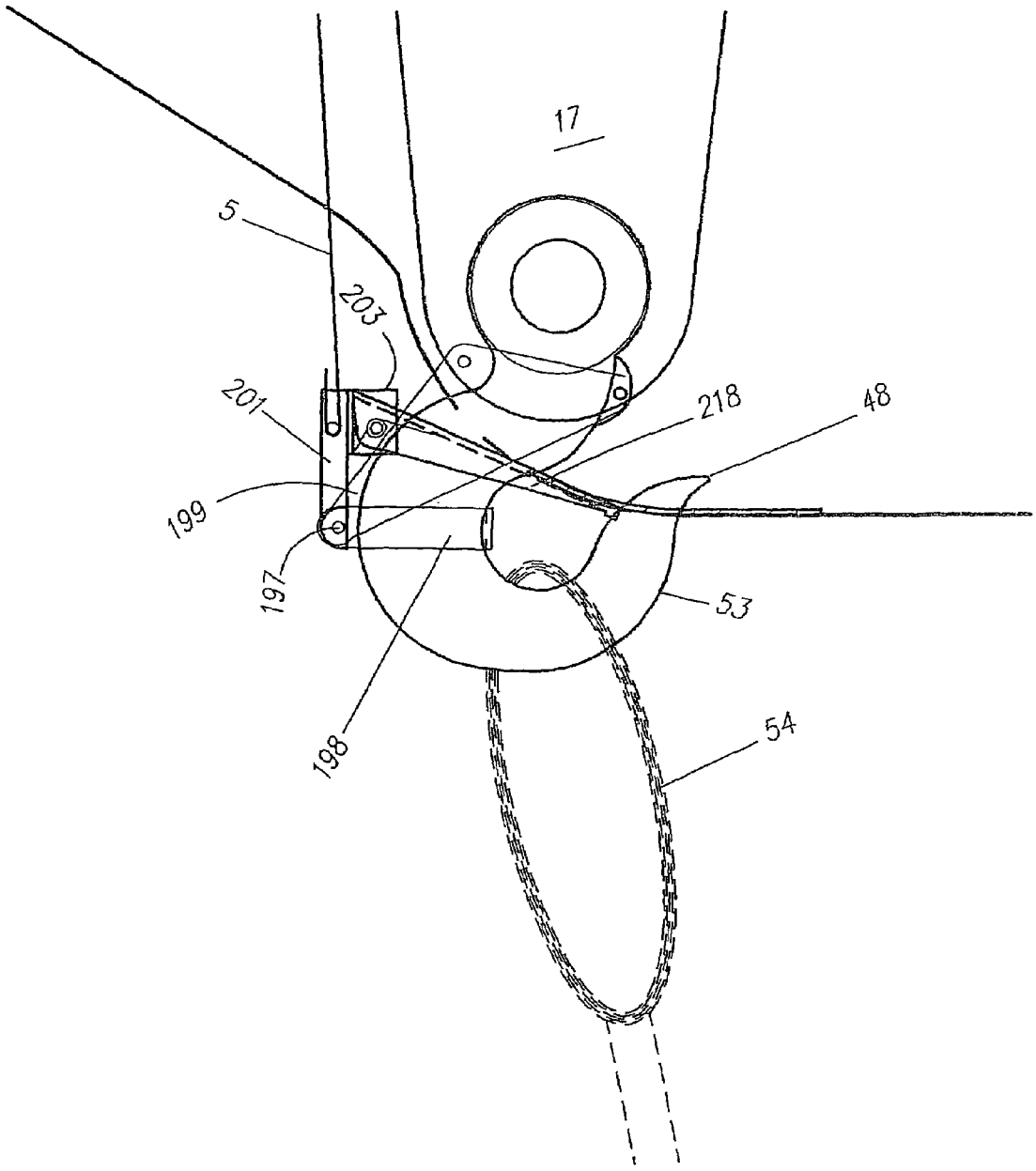
FIG. 22 is a view of a preferred embodiment of the invention, illustrating the positions of the various elements of the guard assembly when the sling hook is ready to receive a load.

As shown in FIGS. 19 and 19A, guard assembly 200 comprises a bar member 201, a clamp member 202, a bracket 203, and latch arms 218 and 219. Bar member 201 further comprises an opening 206 that is in alignment with opening 208 provided to clamp member 202. Bolt 209 of sufficient diameter and length is extended through opening 206 of bar member 201. Load engaging end 5 of cable 4 is then disposed about bolt 209. Clamp member 202 is then placed over bolt 209 so that bolt 209 extends through opening 208 of clamp member 202. Bolt 209, now extending through opening 206 of bar member 201 and opening 208 of clamp member 202, is then secured via nut 210 and thereby provides an anchor point for load engaging end 5 of cable 4. As shown in FIG. 22, lower extremity of bar member 201 is then affixed to collar member 198 and triangular shaped plate 199 of unlatching trigger assembly 18 at point 197 to provide an anchor point for guard assembly 200. Point 197 thereby provides a hinge point for both triangular shaped plate 199 of unlatching trigger assembly 18, as discussed above, as well as for bar member 201 of guard assembly 200.

In configuration, bar member 201 is then welded to back plate 204 of bracket 203. Bracket 203, in addition to having back plate 204 further comprises two end plates 213 and 214, with end plate 213 having an opening 215 in alignment with opening 216 of end plate 214. Bracket 203 is then affixed to latch arms 218 and 219 via a bolt 222, as discussed further below.

Latch arms 218 and 219 are held in position by bracket 203. Latch arm 218 has an opening 220 on its side that is in alignment with an opening 221 provided to latch arm 219. Latch arms 218 and 219 are situated inside bracket 203 so that openings 220 and 221 of latch arms 218 and 219 are in alignment with openings 215 and 216 of end plates 213 and 214, respectively, of bracket 203. Bolt 222 of sufficient diameter and length extends through opening 215 of end plate 213 of bracket 203, through opening 220 of latch arm 218, through opening 221 of latch arm 219, and through opening 216 of end plate 214 of bracket 203. Bolt 222 is secured via nut 226.

Figure 20:
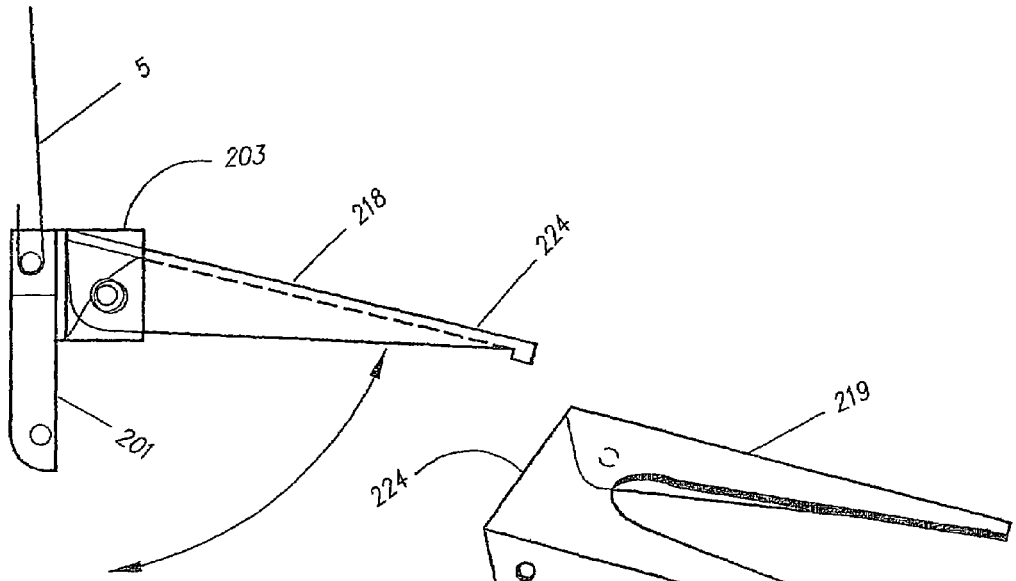
FIG. 20 is a view of a preferred embodiment of the invention depicting the latch arms in the open position.
Figure 21:
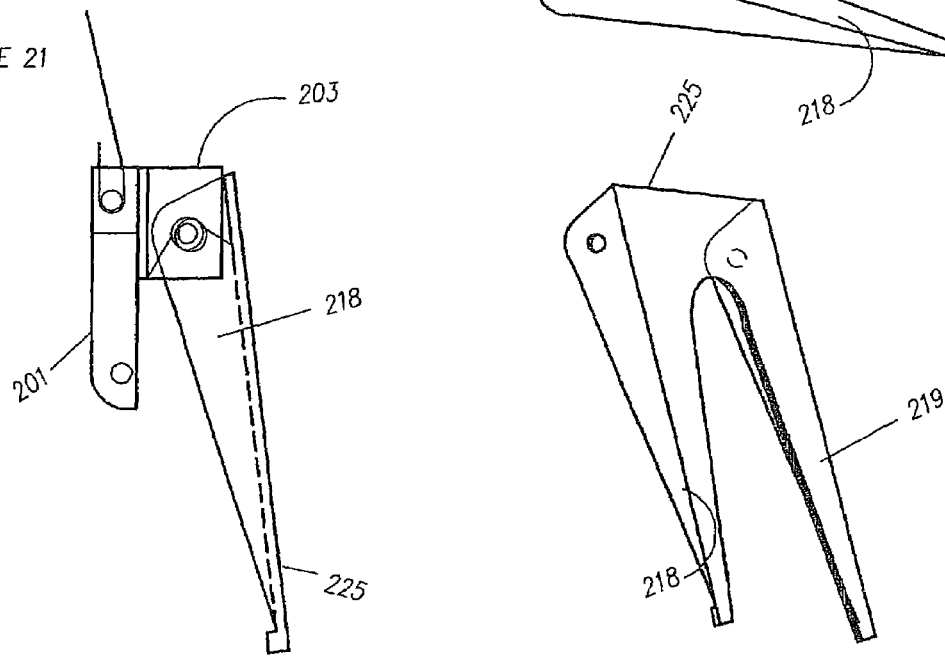
FIG. 21 is a view of a preferred embodiment of the invention, depicting the latch arms in the closed position.

Latch arms 218 and 219 further have an open position 224, as shown in FIG. 20 and a closed position 225, as shown in FIG. 21, and are configured to move between the two positions. In a preferred embodiment, latch arms 218 and 219 are configured to be biased against movement toward closed position 225. As shown in FIGS. 19 and 19A, this can be achieved by providing bolt 222 extending through openings 220 and 221 of latch arms 218 and 219 respectively, a biasing spring 223. In a preferred embodiment, latch arms 218 and 219, biasing spring 223, and load release line 6 of cable 4 should be configured such that when load release line 6 of cable 4 is pulled, latch arms 218 and 219 move to closed position 225 and spring 223 is compressed. When there is no longer a linear force being exerted on load release line 6 of cable 4, biasing spring 223 relaxes to push arms 218 and 219 back to open position 224.

Figure 23:
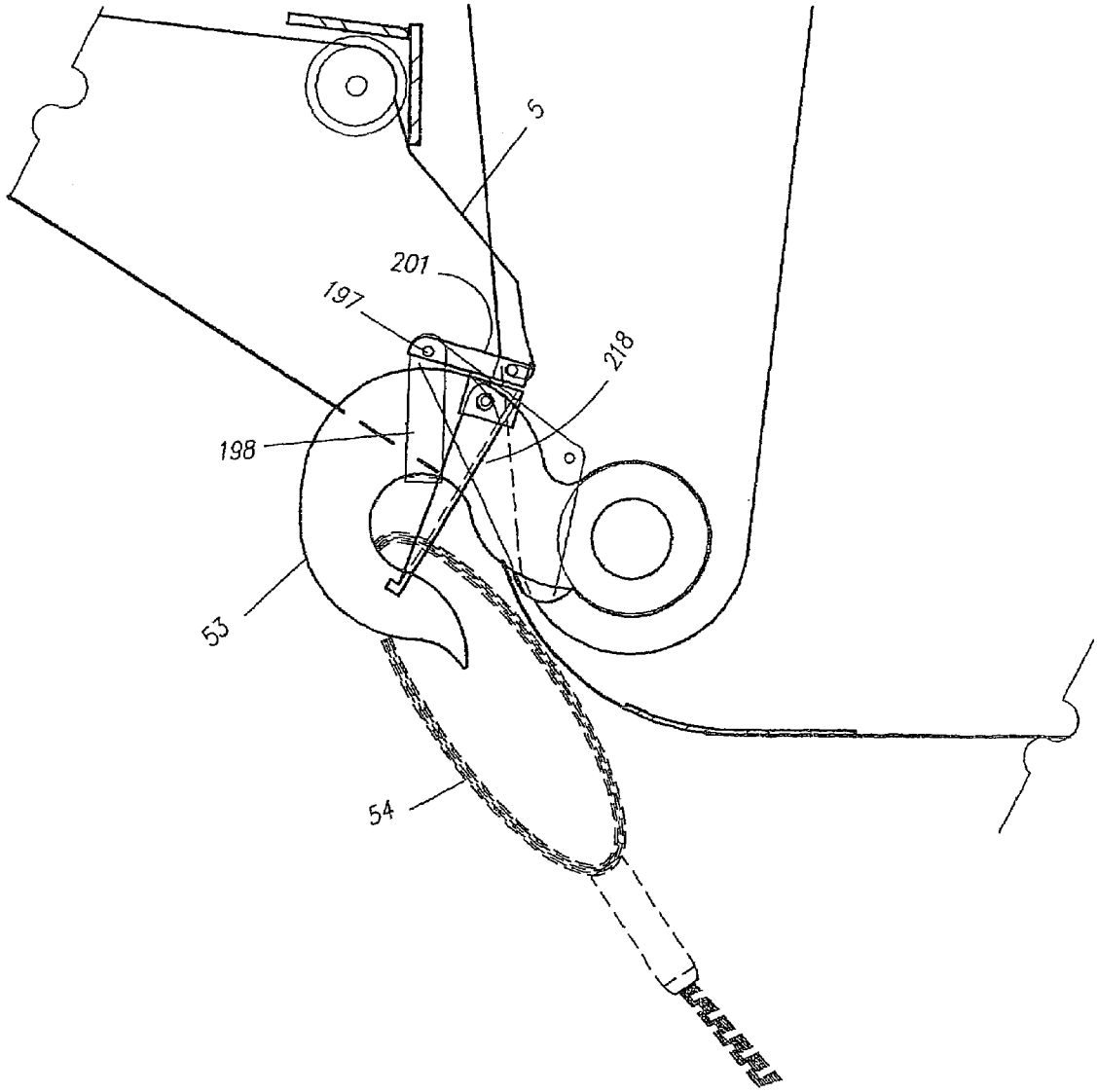
FIG. 23 is a view of a preferred embodiment of the invention, illustrating how the guard assembly functions to block the inadvertent release of the sling from the sling hook.
Figure 24:
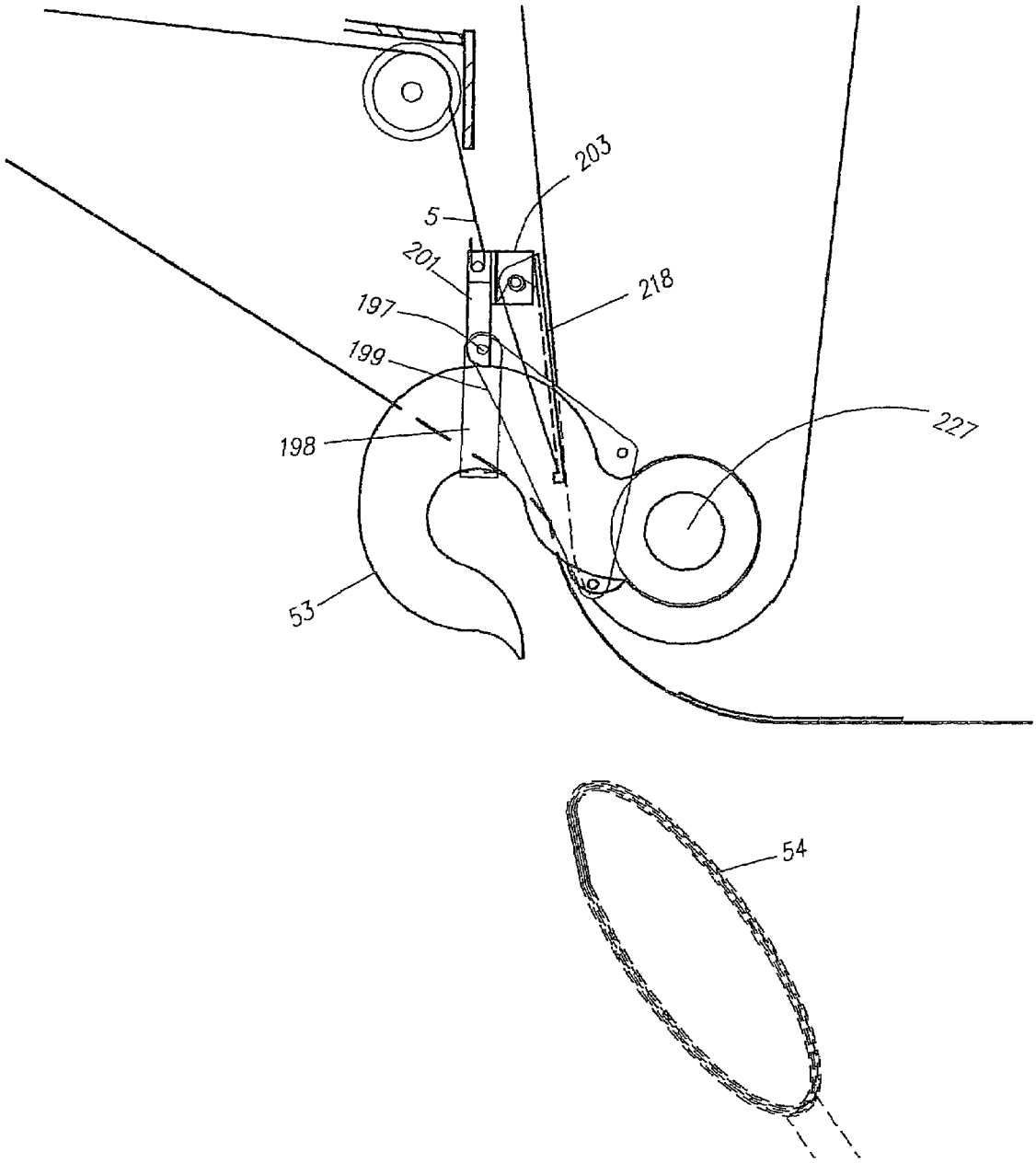
FIG. 24 is a view of a preferred embodiment of the invention, illustrating the positions of the various elements of the guard assembly when the load has been transported to the desired location and positioned at the final anchor location and released.

In operation, guard assembly 200 functions as follows. As depicted in FIG. 22, sling 54 is first applied to sling hook 53. Sling hook 53 is then put into safe position 9 i.e. tip end 48 of sling hook 53 is engaged to guard latch plate 47 situated within housing 2 of apparatus 1. At this point, latch arms 218 and 219 are in open position 224. When latch arms 218 and 219 are in open position 224, they can then be engaged to sling hook 53 on either side below its tip end 48. Assuming that sling 54 applied to sling hook 53 is of sufficient weight, this will then cause tip end 48 of sling hook 53 to be disengaged from guard latch plate 47. Furthermore, the weight of sling 54 may also be sufficient to push sling hook 53 toward a released position 52 prematurely. A shown in FIG. 23, in such a circumstance, as sling hook 53 is pushed toward released position 52, bar member 201 pivots at hinge point 197, to move latch arms 218 and 219, downwards. Thus, in this fashion, latch arms 218 and 219, in open position 224 and engaged to sling hook 53 on either side, move with sling hook 53, as sling hook 53 is moved toward released position 52, to block sling 54 from inadvertently slipping off of sling hook 53. After such a premature release of sling 54 has thereby been avoided, load 7 can then be applied to sling 54 and transported to a desired location and positioned for release. At this point, load release line 6 of cable 4 may then be pulled. As shown in FIG. 24, when load release line 6 is pulled, sling hook 53 pivots from loaded position 51 to released position 52. Furthermore, the application of a linear force to load release line 6 of cable 4 causes latch arms 218 and 219 to move to closed position 225 and biasing spring 223 is compressed. When latch arms 218 and 219 move to closed position 225, they disengage sling hook 53 and no longer present a barrier for sling's 54 release from sling hook 53. Upon cessation of the linear force upon load release line 6 of cable 4, biasing spring 223 relaxes to push latch arms 218 and 219 back to open position 224, whereby latch arms 218 and 219 can then be engaged to sling hook 53 for another load lift application.

Figure 25:
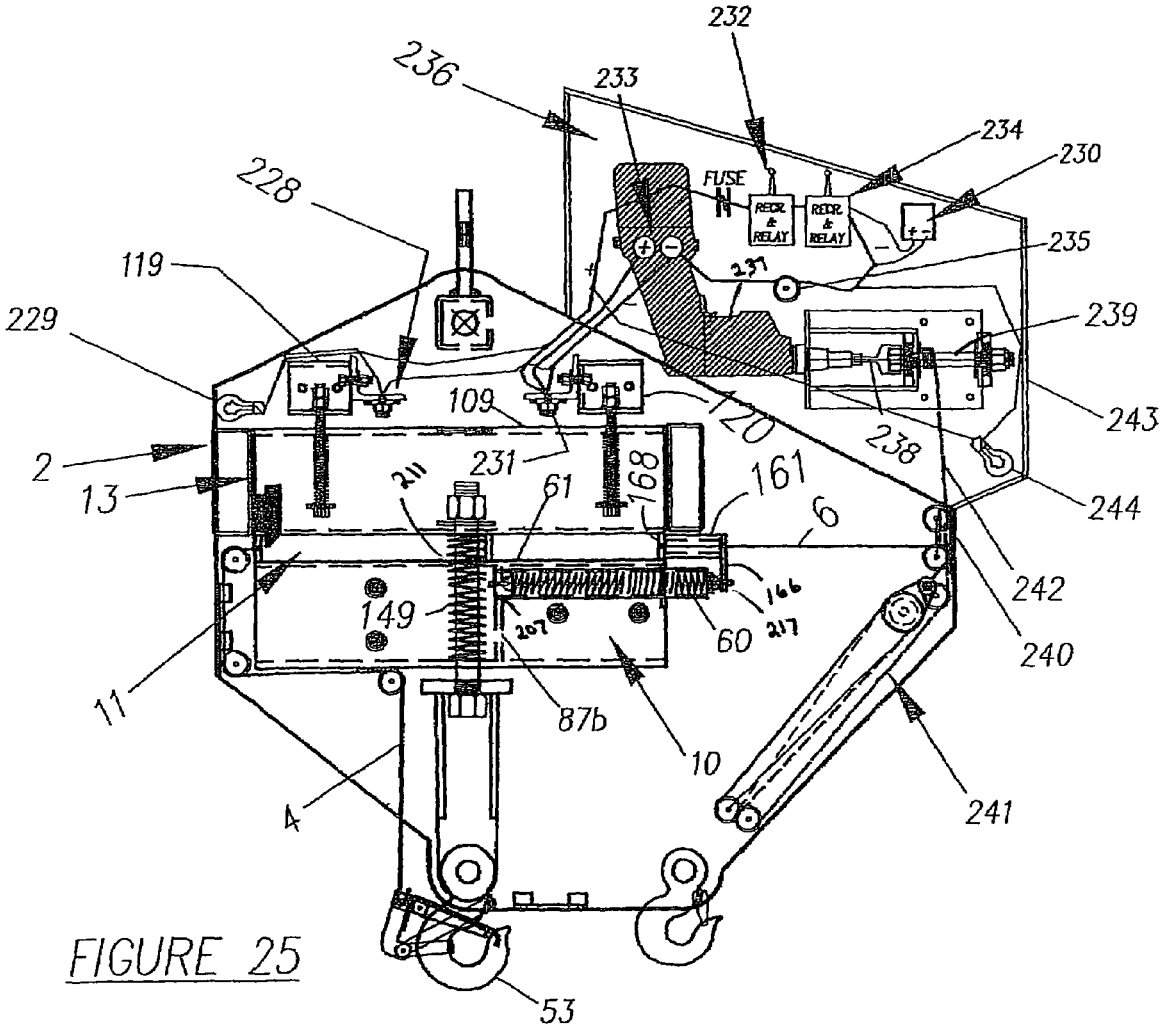
FIG. 25 is view of a preferred embodiment of the invention with the front plate of the housing removed, illustrating a first safety control incorporated into the invention when a load is attached to the load sling hook wherein the warning light switch and the release control switch controlling the motor operatively affixed to the release line are not activated by the radio control device.
Figure 26:
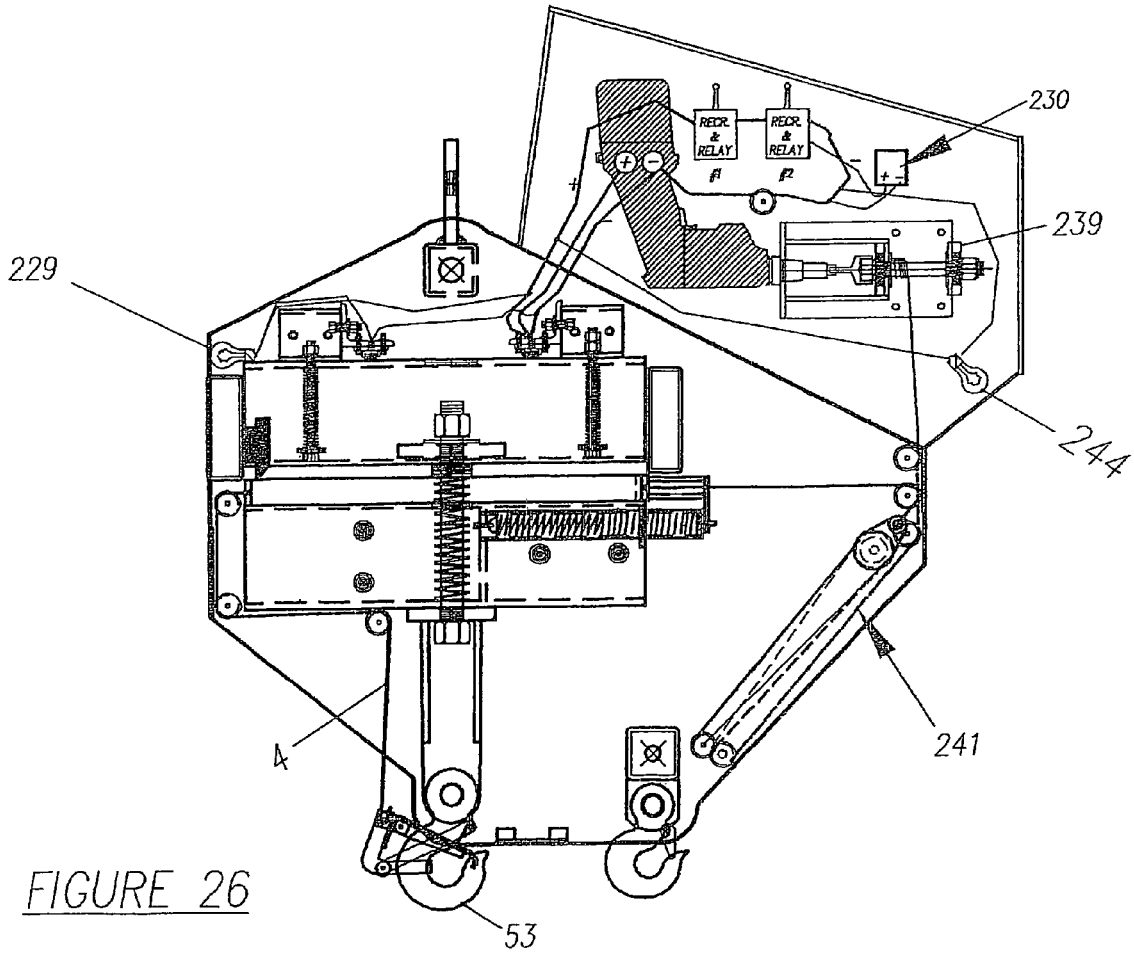
FIG. 26 is a view similar to FIG. 25, but illustrating a second and third safety control incorporated into the invention when no load has been attached to the load sling hook wherein both the warning light switch and the release control switches are activated, but no power has been provided to operate the drive motor.

Turning now to FIGS. 25 and 26, an alternate preferred embodiment of the invention is illustrated. As illustrated by FIG. 6, in one aspect of this embodiment line transfer compression spring assembly 16 is repositioned to provide a more compact apparatus 1. As illustrated in FIG. 25, line transfer compression spring assembly 16 comprises tubular member 161 affixed to the end plate 168 of line transfer bar member 11. Tubular member 161 is also provided with a front plate 166 that extends over one end of tubular member 161 and extends downward to permit the operative attachment of biasing spring 60. Front plate 166 is also provided with a center opening 205 sized to permit load release line 6 to pass through and be fixedly attached to end plate 168. Biasing spring 60 is housed in tubular guide member 61 that is perpendicularly affixed at one end 207 to stiffener plate 87*b* of support structure 10. One end 211 of biasing spring 60 is also affixed to stiffener plate 87*b*. The opposite end 217 of biasing spring 60 extends out from tubular guide member 61 and is affixed to front plate 166.

In another preferred embodiment of this invention a first compression button switch 228 is operatively mounted to bracket 119 wherein switch 228 is activated when top plate 109*a* pushes up against switch 228. (See FIGS. 8 and 8A). Switch 228 is conventionally connected between a yellow caution light 229 mounted on housing 2 and its battery power source 230 so that upon activation (FIG. 26) of switch 228 the caution light 229 will receive power from its power source 230 causing the light 229 to become lit.

In a further preferred embodiment of this invention a second compression button switch 231 is operatively mounted to bracket 120 wherein switch 231 is activated when top plate 109*b* pushes up against switch 231. Switch 231 is conventionally connected between a first conventional remote activated relay 232 and a batter power source 233 so that an electrical current will be applied to one side of relay 232. In an alternate embodiment power sources 230 and 233 can be the same. In a more preferred embodiment a second conventional remote activated relay 234 is electrically connected in series to audible alarm 235 and red warning light 244 which in turn is electrically connected in series to a reversible motor reel assembly 236 to which load release line 6 is operatively attached.

Figure 27:
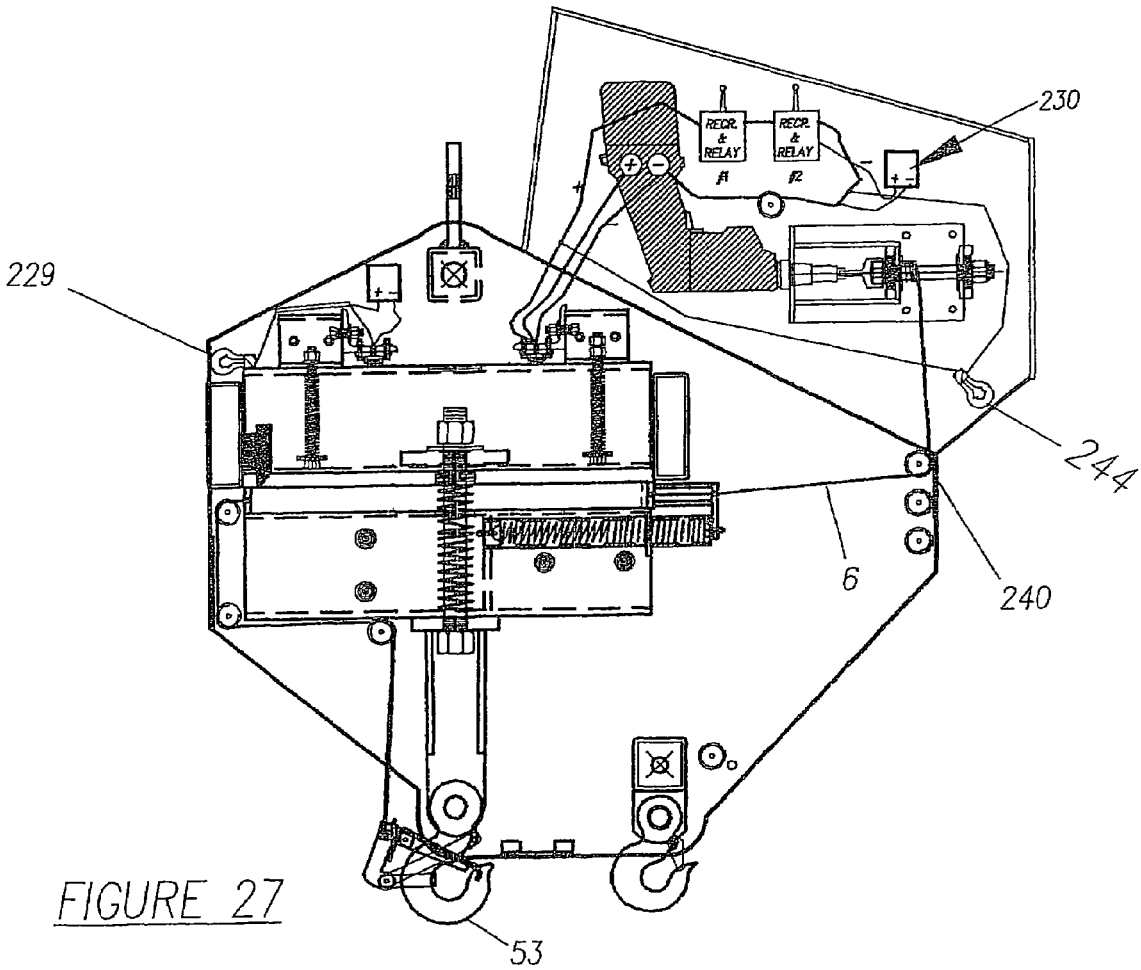
FIG. 27 is an alternate embodiment similar to FIG. 26, but wherein load release line is connected directly to the pulley assembly of the reversible motor reel assembly.

The reversible motor reel assembly 236 includes a reversible motor 237 having an extended shaft 238 to which is mounted a cable reel 239. See FIG. 31. In one embodiment cable 6 can operatively extend about pulley 240 for direct attachment to reel 239 (see FIG. 27). In a more preferred embodiment cable 6 is operatively attached to a conventional pulley assembly 241 as illustrated. In this embodiment cable 242 is operatively attached to reel 239. In both embodiments as reel 239 is rotated in one direction cable 6 will be pulled causing latch activating member 11 to move to the unlocked position. If the reel 239 is rotated in the other direction tension on cable 6 is released permitting it to be pulled in the opposite direction by the spring 60 again resetting latch activating member 11 in a locked position.

FIG. 25 illustrates the position of the various elements of apparatus 1 when the load attached to sling hook 53 is being lifted. In particular neither compression switch 228 or compression switch 231 has been activated by upward movement of movable structure 13. In this configuration reversible motor 237 is not activated to cause line 6 to pulled toward reel 239. FIG. 26 illustrates the position of the various elements of apparatus 1 when the load is not being lifted. In this circumstances movable structure 13 has been moved so that top plates 109*a* and 109*b* have compressed switches 228 and 231. As a result warning light 229 becomes lit providing a visual warning that a load has been released from sling hook 53. Although electrical current has been applied to one side of relay 232 the circuit will not be complete until relay 232 is activated by a remote control (not shown). For safety purposes reversible motor 237 will not be activated until both relay 232 and relay 234 are separately activated. This minimizes the risk that reversible motor 237 will be activated by the accidental pushing of only one remote control button.

Figure 28:
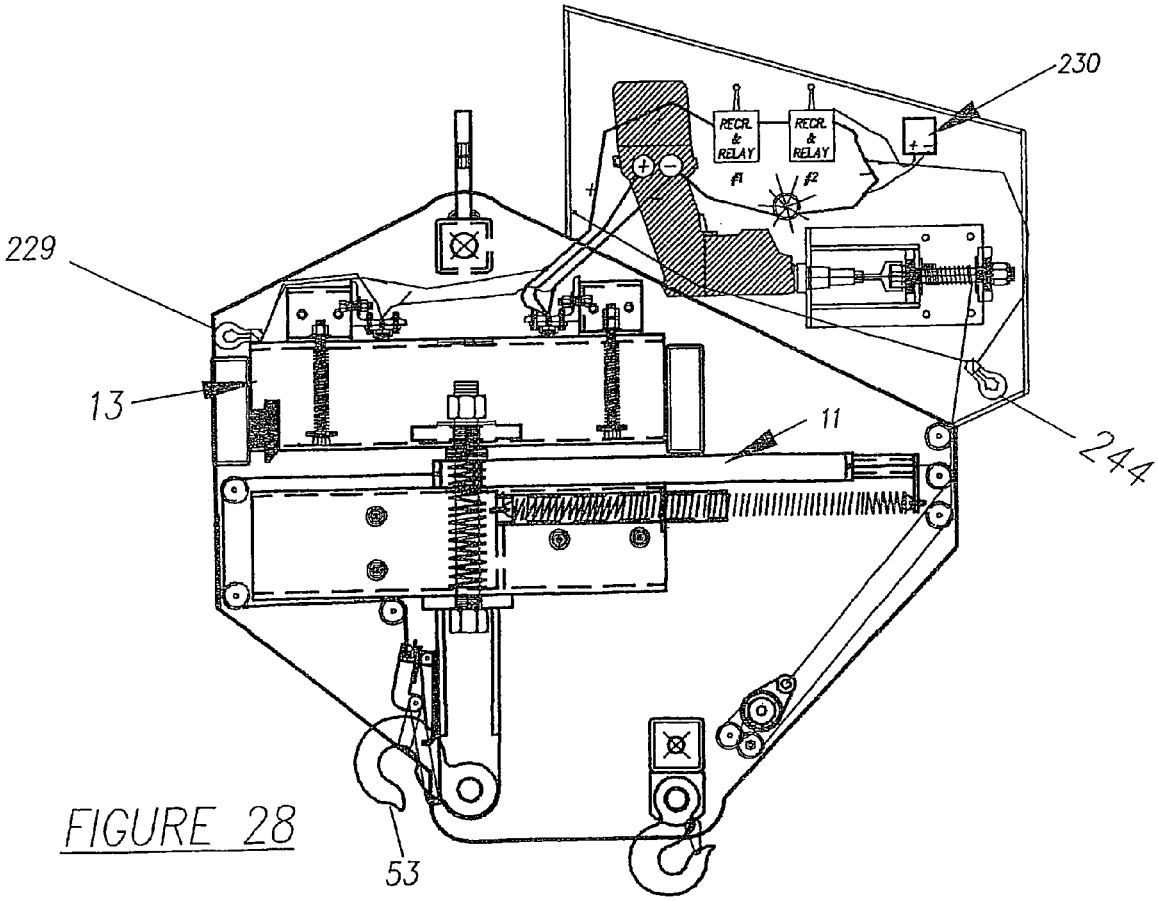
FIG. 28 is a view similar to FIG. 26 wherein line 242 has been reeled onto the reel of the reversible motor reel assembly to cause the load to be released from the sling hook.

When it is desired to release the load from the sling hook 53 both relay 232 and relay 234 are activated by pressing of two separate buttons on a conventional remote control device (not shown). When both relays are activated audio alarm 235 is activated to provide an audible sound to warn personnel in the vicinity. In addition red warning light 244 is activated to warn personnel that is being released. In a preferred embodiment a known time delay device can be operatively inserted to allow the warning light 233 to be lit before motor 237 is activated. As illustrated in FIG. 28 motor 237 is also activated causing shaft 238 and reel 239 to rotate which in turn causes line 242 to be reeled in on reel 239. This causes line 6 to be pulled toward reel 239 which in turn causes latch activating member 11 to be pulled to a load release position as explained above.

In a more preferred embodiment reversible motor reel assembly 236 is structured to fit within an extended housing 243. In another preferred embodiment it is preferred that reversible motor 237 include a conventional adjustable clutch mechanism to prevent strain on reversible motor 237 above a predetermined amount, as well as to permit the motor 237 to operate within varying amounts of minimum loads.

Figure 30:
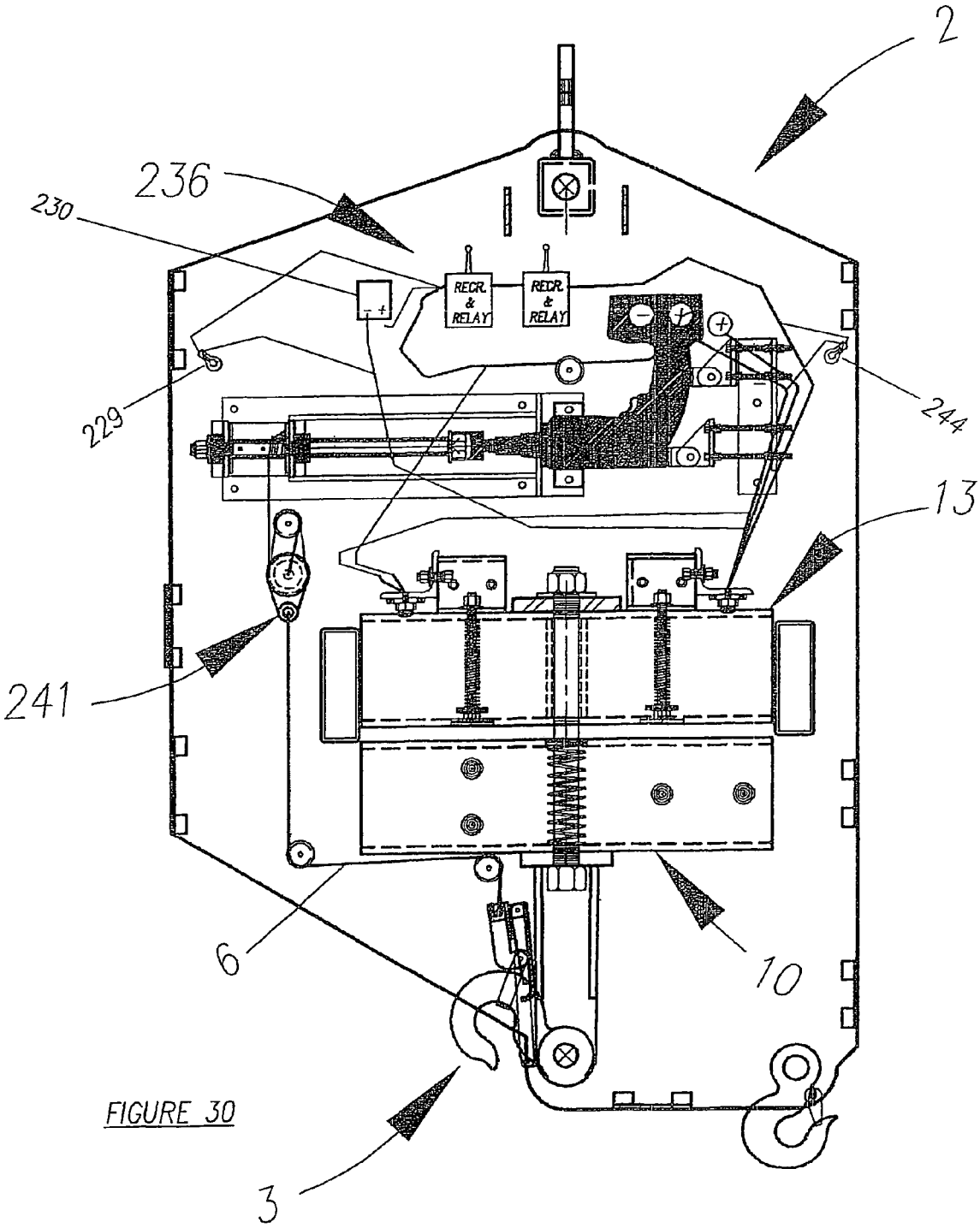
FIG. 30 is similar to FIG. 29 except the compression switches have been activated and the load-engaging assembly is positioned to release the load from the sling hook.

In another alternate embodiment illustrated in FIGS. 29 and 30, construction of the apparatus 1 can be simplified to provide it with a narrower profile wherein reversible motor reel assembly 236 and pulley assembly 241 are positioned within housing 2 to permit load release line 6 to directly connect to load-engaging assembly 3. In this embodiment, load-activated lock assembly 8 includes only support structure 10 and moveable structure 13 which are operatively connected in the other alternatives. In this embodiment the warning light 229 is lit when the load is off the sling hook 53. The compression button switches 228 and 231 are activated when there is no load on sling hook 53, and both relays 232 and 234 can then be remotely activated.

In still another embodiment the reversible motor reel assembly 236 can be mounted parallel to load-activated lock assembly 8 if a lower profile is desired. Such construction would also permit easier access for adjustments of the various parts within housing 2.

Figure 31:
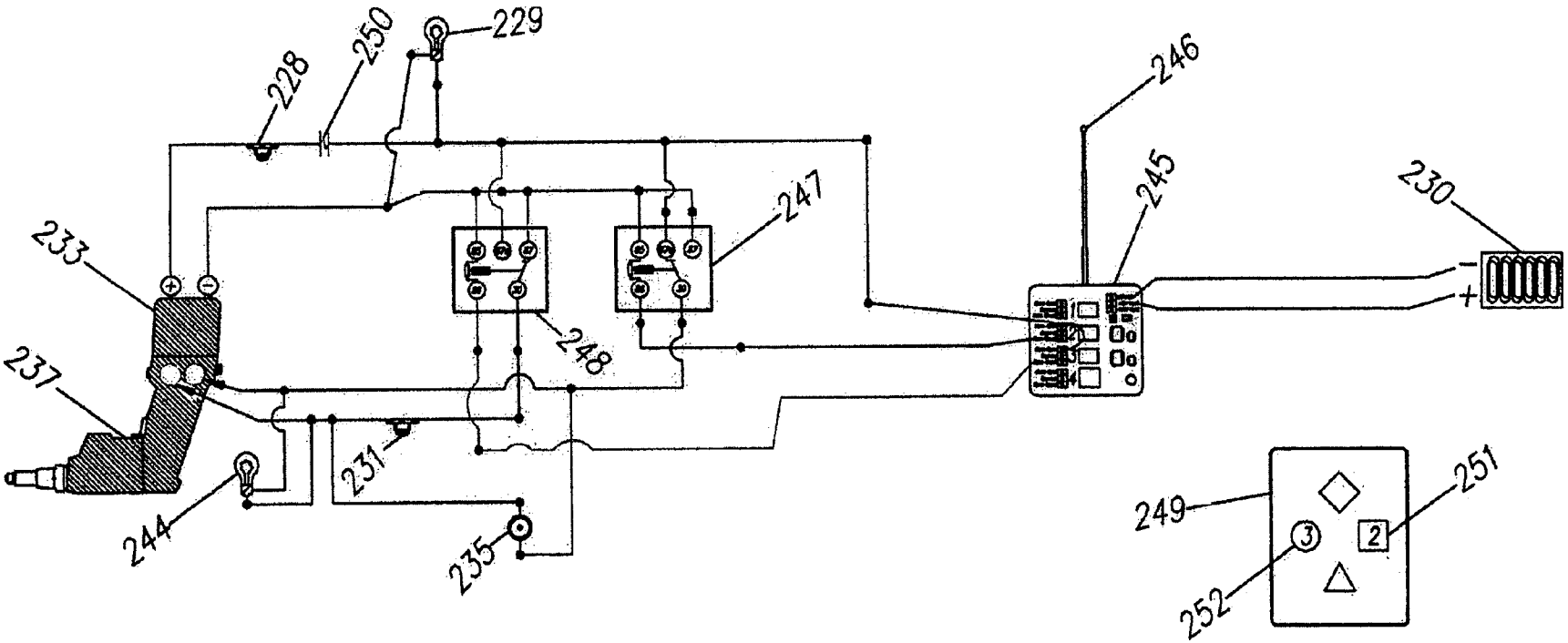
FIG. 31 is an electrical schematic illustrating a preferred embodiment of the electrical circuitry for the warning lights and audio horn controlled by a remote transmitter.

FIG. 31 illustrates one embodiment of the electrical circuitry that can be utilized in this invention. Power source 230, such as a 12 volt battery pack, is electrically connected to a receiver-relay pack 245 having an antenna 246 for receiving signals from a transmitter 249 to direct which relays in pack 245 are to be activated. Electrically connected to pack 245 are forward relay 247 and reverse relay 248 which in turn are connected to motor power source 233, such as a 14.4 rechargeable battery pack, and to motor 237 to control the direction of rotation that motor 237 will turn motor shaft 238. Electrically connected in series between the motor power source 233 and one side of relays 247 and 248 are compression switch 228 and caution light 229. Electrically connected as illustrated between the motor 237 and the other side of relays 247 and 248 are compression switch 231, audible alarm 235 and warning light 244. In a more preferred embodiment fuse 250 is electrically inserted between the compression switch 228 and caution light 229 to prevent power surges from damaging the circuit components.

When button 251 of transmitter 249 is pressed a radio signal is transmitted and then received by antennae 246 that activates relay 245 to send to power to forward relay 247 (which is activated by motor power source 233) that in turn sends completes the circuit to power motor 237 to operate in the forward direction. At the same time power is sent to activate both audible alarm 235 and the warning light 244.

When button 252 of transmitter 249 is pressed a second radio signal is transmitted and then received by antennae 246 that activates relay 245 to send power to reverse relay 248 (which is activated by the motor power source 233) that in turn completes the circuit to power motor 237 to operate in the reverse direction.

In conclusion, the invention provides an improved apparatus 1 for the loading and unloading of materials that will make load-lift operations safer, more efficient, and less costly. In constructing apparatus 1, the inventor contemplates using steel. However, it is anticipated that various other materials could also be acceptable to construct apparatus 1. The suitability of a certain material would depend on various factors such as the weight of the load desired to be lifted, and the transporting distance.

While the invention has been described in terms of its preferred embodiment, other embodiments will be apparent to those of skill in the art from a review of the foregoing. Those embodiments as well as the preferred embodiments are intended to be encompassed by the scope and spirit of the following claims.

I claim:

1. An apparatus for latching and unlatching a load from a sling having a housing affixable to a load lift line; a load engaging assembly including a latch pivotly attached to a latch attachment assembly and an unlatching trigger assembly; and a load activated lock operatively attached to the load engaging assembly to latch and unlatch the load engaging assembly and including a support structure affixed to the housing, a latch activating member slidably mounted on the support structure, and a moveable locking structure positioned within the housing and operatively adjacent the latch activating member to engage and prevent latch activating member from sliding movement when a load is applied to the latch, the improvement to which comprises:

a. a switch mounted to the housing at a position to be activated by contact with the moveable locking structure when there is no load attached to the load engaging assembly;
b. a power source;
c. a light operatively attached to the switch and the power source to illuminate when the switch is activated;
d. a second switch mounted to the housing at a position to be activated by contact with the moveable structure when no load is attached to the load engaging assembly;
e. a sound producing device; and
f. a relay switch operatively connecting the second switch and the sound producing device when the relay switch is activated.

2. An apparatus according to claim 1 wherein the relay switch is a remote controlled relay switch, and further comprising a radio controlled receiver operatively affixed to the relay switch to activate the relay switch when the radio controlled receiver receives a predetermined signal from a radio signal broadcast device.

3. An apparatus for latching and unlatching a load from a sling having a housing affixable to a load lift line; a load engaging assembly including a latch pivotally attached to a latch attachment assembly and an unlatching trigger assembly; and a load activated lock operatively attached to the load engaging assembly to latch and unlatch the load engaging assembly and including a support structure affixed to the housing, a latch activating member slidably mounted on the support structure, and a moveable locking structure positioned within the housing and operatively adjacent the latch activating member to engage and prevent latch activating member from sliding movement when a load is applied to the latch, the improvement to which comprises:

a. a switch mounted to the housing at a position to be activated by contact with the moveable locking structure when there is no load attached to the load engaging assembly;
b. a power source;
c. a light operatively attached to the switch and the power source to illuminate when the switch is activated;
d. a second switch mounted to the housing at a position to be activated by contact with an upper floating locking assembly when no load is attached to the load engaging assembly;
e. a sound producing device;
f. a motor;
g. a first relay switch operatively connected to the second switch and to an activation device to close an electrical circuit when the second switch is activated and an activation signal is received from the activation device; and
h. a second relay switch operatively connected to the first relay switch, to the sound producing device, and to the motor to close an electrical circuit when the second switch is activated and the first relay switch is closed and a second activation signal is received from the activation device.

4. An apparatus according to claim 3, wherein the motor is a reversible motor.

5. An apparatus according to claim 3, wherein the motor comprises a drive shaft and a clutch operatively attached to the drive shaft to disengage the motor from its drive shaft when the motor is subjected to a torque greater than a predetermined amount.

6. An apparatus according to claim 5, wherein the apparatus further comprises a load release line operatively connected at one end to the latch activating member and at its other end to the drive shaft.

7. An apparatus according to claim 5, wherein the apparatus further comprises a load release line operatively connected at one end to a force multiplier device that is operatively connected to the drive shaft by a reel cable.

8. An apparatus for latching and unlatching a load from a sling comprising:

a. a housing comprising a front plate parallel to and separated from a rear plate, by at least one edge plate affixed to opposing perimeter sections of the front and rear plates;
b. a load engaging assembly comprising a latch to which the load can be attached and a latch attaching assembly to which the latch is pivotally attached;
c. a load-activated lock assembly comprising a support structure affixed to the housing, a latch activating member having a keyhole and positioned within the housing to slide over the support structure, a moveable structure having a key member sized and shaped to fit into the keyhole, the moveable structure biasly attached to the latch attaching assembly and positioned relative to the latch activating member to permit the key member to be inserted into the keyhole when the moveable structure is moved toward the latch activating member by the application of a load on the latch;

d. a cable attached at one end to the latch and at its opposite end to one end of the latch activating member;

e. a load release line attached at one end to the opposite end of the latch activating member.

9. An apparatus according to claim 8 further comprising:

a. a switch mounted to the housing at a position to be activated by contact with the movable structure when no load is attached to the latch, and b. a light operatively attached to the switch to illuminate when the switch is activated.

10. An apparatus according to claim 9 further comprising:

a. a second switch mounted to the housing at a position to be activated by contact with the moveable structure when no load is attached to the latch;

b. a sound producing device; and c. a relay switch operatively connecting the second switch and the sound producing device when the relay switch is activated.

11. An apparatus according to claim 10 further comprising a radio controlled receiver operatively affixed to the relay switch to activate the relay switch when the radio controlled receiver receives a predetermined signal from a radio signal broadcast device.

12. An apparatus according to claim 11 wherein the load release line is operatively connected at one end to the latch activating member and at its other end to a drive shaft.

13. An apparatus according to claim 12 wherein the load release line is operatively connected at one end to the latch activating member and at its other end to a force multiplier device that is operatively connected to a drive shaft by a reel cable.

14. An apparatus according to claim 9 further comprising:

a. a second switch mounted to the housing at a position to be activated by contact with the movable structure when no load is attached to the latch, b. a sound producing device;

c. a motor having a drive shaft;

d. a first relay switch operatively connected to the second switch and to an activation device to close an electrical circuit when the second switch is activated and an activation signal is received from the activation device; and e. a second relay switch operatively connected to the first relay switch, to the sound producing device, and to the motor to close an electrical circuit when the second switch is activated and the first relay switch is closed and a second activation signal is received from the activation device.

15. An apparatus according to claim 14 wherein the motor comprises a clutch operatively attached to the drive shaft to disengage the motor from its drive shaft when the motor is subjected to a torque greater than a predetermined amount.

* * * * *